US010741109B2

(12) United States Patent
Enriquez

(10) Patent No.: US 10,741,109 B2
(45) Date of Patent: Aug. 11, 2020

(54) QUADRILATERAL DISPLAY AND METHOD FOR FORMING THE SAME

(71) Applicant: R.R. Donnelley & Sons Company, Chicago, IL (US)

(72) Inventor: Carlos Enriquez, Pleasant Prairie, WI (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 15/690,031

(22) Filed: Aug. 29, 2017

(65) Prior Publication Data

US 2019/0066550 A1 Feb. 28, 2019

(51) Int. Cl.
*G09F 15/00* (2006.01)
*G09F 1/06* (2006.01)

(52) U.S. Cl.
CPC ..... *G09F 15/0062* (2013.01); *G09F 1/065* (2013.01); *G09F 15/0025* (2013.01); *G09F 2015/0093* (2013.01)

(58) Field of Classification Search
CPC ..... G09F 15/0025; G09F 15/0062; G09F 2015/0093
See application file for complete search history.

(56) References Cited

U.S. PATENT DOCUMENTS 1,028,147 A 6/1912 Stranders
1,670,464 A 12/1923 Marsh
(Continued)

FOREIGN PATENT DOCUMENTS

CN 1387175 A 12/2002
CN 101473360 7/2009
(Continued)

OTHER PUBLICATIONS

International Seraching Authority, "International Search Report and Written Opinion," issued in connection with the International Application No. PCT/US2016/064478, dated Jan. 24, 2017, 15 pages.
(Continued)

*Primary Examiner* — David R Dunn
*Assistant Examiner* — Christopher E Veraa
(74) *Attorney, Agent, or Firm* — Hanley, Flight & Zimmerman, LLC

(57) ABSTRACT

In one example, a quadrilateral display includes a shroud including a first section, a second section, a third section and a fourth section, the first section, the second section, the third section and the fourth section being rotatably disposed relative to adjacent ones of the first section, the second section, the third section and the fourth section and a plurality of anchors including a first anchor attached to the first section, a second anchor attached to the second section, a third anchor attached to the third section and a fourth anchor attached to the fourth section, the plurality of anchors being disposed in a first position within the shroud in a stowed position and a second position within the shroud in a deployed position. A first elastic member connects the first anchor and the second anchor to bias the first section and the second section toward one another about the first joint and a second elastic member connects the third anchor and the fourth anchor to bias the third section and the fourth section toward one another about the second joint. The first elastic member and the second elastic member bias the shroud from a stowed position to a deployed position with the first section, the second section, the third section and the fourth section forming a quadrilateral shape when the plurality of anchors are positioned in the second position.

21 Claims, 12 Drawing Sheets

(56) References Cited

U.S. PATENT DOCUMENTS 1,545,771 A 7/1925 Hout
1,576,672 A 3/1926 Miller
1,656,341 A 1/1928 Smith
1,687,616 A 10/1928 Huye
1,902,566 A 3/1933 Marsh
2,108,349 A 2/1938 Rasmussen
2,113,288 A 4/1938 Berger
2,142,826 A 1/1939 Rosello
2,153,460 A 4/1939 Giles
2,210,317 A 8/1940 Dueringer
2,283,406 A 5/1942 Bacon
2,290,144 A 7/1942 Katz
2,404,089 A 7/1946 Pollock
2,601,374 A 6/1952 Ditzler et al.
2,637,924 A 5/1953 Hutt
2,728,461 A 12/1955 Paige
2,773,324 A 12/1956 Drueck, Jr.
2,833,074 A 5/1958 Jannes
2,892,276 A 6/1959 Nelson
2,918,178 A 12/1959 Leone
2,984,920 A 5/1961 Acosta et al.
3,015,898 A 1/1962 Keeslar
3,091,877 A 6/1963 Luchsinger
3,234,682 A 2/1966 Frankl
3,267,597 A 8/1966 Jannes
3,302,321 A 2/1967 Walker
3,571,958 A 3/1971 Trevor
3,665,669 A 5/1972 Huber
3,666,607 A 5/1972 Weissman
4,234,148 A 11/1980 Maddestra et al.
4,610,363 A 9/1986 Flum et al.
4,619,426 A 10/1986 Drueck, Jr.
4,750,283 A 6/1988 Halpern
4,770,379 A 9/1988 Estvold
4,773,622 A 9/1988 Herlin
4,774,780 A 10/1988 Crowell
4,790,714 A 12/1988 Schnapp
4,854,060 A 8/1989 Corbo et al.
4,940,199 A 7/1990 Hall
4,984,848 A 1/1991 Scalisi et al.
4,993,846 A 2/1991 Diamond et al.
5,000,717 A 3/1991 Pfeiffer
5,090,349 A 2/1992 Wilson
5,193,466 A 3/1993 Eder
5,197,631 A 3/1993 Mishima
5,297,677 A 3/1994 Burian et al.
5,416,997 A 5/1995 Dyment et al.
5,454,180 A 10/1995 Volpe
5,467,547 A 11/1995 Fortner
5,632,390 A 5/1997 Podergois
5,752,649 A 5/1998 Weder
5,758,438 A 6/1998 Crowell
5,778,959 A 7/1998 Guetschow
5,787,621 A * 8/1998 Leksell ..... G09F 15/0025 40/606.12
5,809,673 A 9/1998 Johnson et al.
5,868,367 A 2/1999 Smith
5,878,945 A 3/1999 Weder
5,937,553 A 8/1999 Maran
5,966,857 A 10/1999 Pettersson et al.
5,983,538 A 11/1999 Crowell
6,311,418 B1 11/2001 Crowell
6,347,772 B1 2/2002 L'Hotel
6,497,601 B1 12/2002 Ward
7,134,230 B1 11/2006 Boens et al.
7,159,350 B2 1/2007 L'Hotel
7,234,253 B2 6/2007 Ossmann
7,437,842 B2 * 10/2008 Sgambellone ..... G09F 1/06 248/174
7,634,865 B2 12/2009 L'Hotel
7,726,054 B2 6/2010 Mestres Armengol et al.
7,774,964 B2 8/2010 L'Hotel
7,980,013 B2 7/2011 Hsu
7,980,016 B2 7/2011 L'Hotel
8,099,883 B2 1/2012 Mestres Armengol et al.
8,112,925 B2 2/2012 Tzuo
8,228,410 B2 7/2012 Raynor et al.
8,291,631 B2 10/2012 Wilder
8,458,939 B2 6/2013 Arthur et al.
8,590,188 B2 11/2013 Mirsch
8,701,321 B2 4/2014 Da Fonseca et al.
8,776,415 B2 * 7/2014 Kawaguchi ..... G09F 1/06 40/124.07
8,826,833 B1 9/2014 Fischer et al.
8,863,418 B2 10/2014 Acker et al.
8,875,908 B2 11/2014 L'Hotel
9,123,262 B1 * 9/2015 Frost ..... G09F 7/00
9,173,485 B2 11/2015 Fischer et al.
9,569,160 B2 2/2017 Tsuchida et al.
9,715,840 B1 * 7/2017 Warmus ..... G09F 1/065
9,734,734 B2 8/2017 Lyon
9,779,640 B2 10/2017 Ruhaak
9,812,038 B2 11/2017 Lyon
9,978,292 B2 5/2018 Santoro, Jr.
10,008,138 B2 6/2018 Bonifas
10,170,020 B2 1/2019 Cwidak et al.
10,223,939 B2 3/2019 Warmus
2004/0111930 A1 6/2004 Ossmann
2006/0260165 A1 * 11/2006 Chenel ..... G09F 15/0025 40/603
2007/0245610 A1 * 10/2007 Mestres Armengol ... A47F 5/10 40/610
2007/0294925 A1 * 12/2007 L'Hotel ..... G09F 1/06 40/124.19
2008/0066353 A1 3/2008 Mills
2008/0083146 A1 4/2008 Martin Presa
2010/0000131 A1 * 1/2010 Tzuo ..... G09F 1/06 40/1
2010/0043261 A1 * 2/2010 Arthur ..... G09F 1/06 40/1
2010/0072330 A1 * 3/2010 Tzuo ..... A47B 43/02 248/174
2010/0236117 A1 9/2010 Mestres Armengol et al.
2011/0088300 A1 * 4/2011 Martin Presa ..... G09F 1/06 40/606.12
2011/0179685 A1 * 7/2011 Mirsch ..... G09F 1/065 40/610
2012/0012734 A1 1/2012 Tzuo
2012/0227297 A1 * 9/2012 Kawaguchi ..... G09F 1/06 40/610
2013/0192110 A1 * 8/2013 Da Fonseca ..... G09F 1/06 40/606.12
2013/0219760 A1 * 8/2013 Acker ..... G09F 1/06 40/610
2014/0205772 A1 * 7/2014 Sitton ..... G09F 15/0062 428/12
2014/0265777 A1 9/2014 Fischer et al.
2015/0265070 A1 * 9/2015 Mestres Armengol ... A47F 5/11 248/174
2016/0335925 A1 11/2016 Ruhaak
2016/0335934 A1 11/2016 Lyon
2016/0335935 A1 11/2016 Lyon
2017/0193866 A1 7/2017 Bonifas
2017/0213485 A1 7/2017 Santoro, Jr.
2017/0249874 A1 8/2017 Lopez Fernandez
2017/0294149 A1 10/2017 Lyon
2018/0040262 A1 2/2018 Lyon
2018/0075781 A1 3/2018 Cwidak et al.
2018/0075788 A1 3/2018 Warmus et al.
2018/0122272 A1 5/2018 Warmus
2018/0211571 A1 7/2018 Enriquez
2018/0268748 A1 9/2018 Enriquez
2019/0279534 A1 9/2019 Lyon

FOREIGN PATENT DOCUMENTS

CN 102005160 4/2011
CN 202711641 U 1/2013
CN 203192354 9/2013
CN 204257165 4/2015
CN 205722637 11/2016
CN 101061527 10/2017
DE 2658506 1/1978

(56) References Cited

FOREIGN PATENT DOCUMENTS

| | | |
|---|---|---|
| DE | 4005925 | 10/1991 |
| DE | 4314654 | 11/1994 |
| DE | 9320993 | 8/1995 |
| DE | 202010015312 | 1/2011 |
| DE | 202011002980 | 4/2011 |
| DE | 202014106297 | 3/2015 |
| DK | 9500055 | 5/1995 |
| DK | 9500277 | 9/1995 |
| EP | 1741368 | 1/2007 |
| EP | 1830334 | 9/2007 |
| EP | 1926076 | 5/2008 |
| EP | 2290637 | 3/2011 |
| EP | 2400477 | 12/2011 |
| ES | 2212927 | 8/2004 |
| ES | 2255857 | 7/2006 |
| FR | 1254983 | 3/1961 |
| FR | 2210317 | 6/1974 |
| FR | 2232259 | 12/1974 |
| FR | 2233912 | 1/1975 |
| FR | 2571949 | 4/1986 |
| FR | 2574968 | 6/1986 |
| FR | 2650907 | 2/1991 |
| FR | 2680030 | 2/1993 |
| FR | 2691621 | 12/1993 |
| FR | 2730148 | 8/1996 |
| FR | 2735264 | 12/1996 |
| FR | 2745109 | 8/1997 |
| FR | 2760801 | 9/1998 |
| FR | 2760802 | 9/1998 |
| FR | 2760880 | 9/1998 |
| FR | 2770320 | 4/1999 |
| FR | 2911425 | 7/2008 |
| FR | 2925203 | 6/2009 |
| FR | 2925204 | 6/2009 |
| FR | 2929035 | 9/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 4/1972 |
| GB | 1317155 | 5/1973 |
| JP | 2003530602 | 10/2003 |
| WO | 9634379 | 10/1996 |
| WO | 9936900 | 7/1999 |
| WO | 02095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2008125703 | 10/2008 |
| WO | 2010019086 | 2/2010 |
| WO | 2010130485 | 11/2010 |
| WO | 2011092209 | 8/2011 |
| WO | 2011113123 | 9/2011 |
| WO | 2012061375 | 5/2012 |
| WO | 2012164114 | 12/2012 |
| WO | 2016057067 | 4/2016 |
| WO | 2016071868 | 5/2016 |
| WO | 2017116605 | 7/2017 |
| WO | 2018027118 | 2/2018 |

OTHER PUBLICATIONS

International Seraching Authority, "International Search Report," issued in connection with the International Application No. PCT/US2017/045471, dated Oct. 18, 2017, 5 pages.

International Seraching Authority, "Written Opinion," issued in connection with the International Application No. PCT/US2017/045471, dated Oct. 18, 2017, 5 pages.

United States Patent and Trademark Office, "Non-Final Office Action," issued in connection with U.S. Appl. No. 14/988,616, dated Apr. 11, 2017, 8 pages.

United States Patent and Trademark Office, "Final Office Action," issued in connection with U.S. Appl. No. 14/988,616, dated Oct. 30, 2017, 9 pages.

United States Patent and Trademark Office, "Notice of Allowance," issued in connection with U.S. Appl. No. 14/988,616, dated Feb. 28, 2018, 8 pages.

United States Patent and Trademark Office, "Non-Final Office Action," issued in connection with U.S. Appl. No. 14/709,266, dated May 23, 2016, 12 pages.

United States Patent and Trademark Office, "Notice of Allowance," issued in connection with U.S. Appl. No. 14/709,266, dated Sep. 26, 2016, 20 pages.

United States Patent and Trademark Office, "Notice of Allowance," issued in connection with U.S. Appl. No. 14/709,266, dated Apr. 12, 2017, 5 pages.

United States Patent and Trademark Office, "Non-Final Office Action," issued in connection with U.S. Appl. No. 14/709,285, dated Sep. 15, 2016, 8 pages.

United States Patent and Trademark Office, "Final Office Action," issued in connection with U.S. Appl. No. 14/709,285, dated Mar. 15, 2017, 7 pages.

United States Patent and Trademark Office, "Notice of Allowance," issued in connection with U.S. Appl. No. 14/709,285, dated Jul. 3, 2017, 8 pages.

United States Patent and Trademark Office, "Non-Final Office Action," issued in connection with U.S. Appl. No. 14/711,739, dated Sep. 16, 2016, 7 pages.

United States Patent and Trademark Office, "Final Office Action," issued in connection with U.S. Appl. No. 14/711,739, dated Mar. 21, 2017, 6 pages.

United States Patent and Trademark Office, "Notice of Allowance," issued in connection with U.S. Appl. No. 14/711,739, dated Jun. 8, 2017, 9 pages.

United States Patent and Trademark Office, "Non-Final Office Action," issued in connection with U.S. Appl. No. 15/229,920, dated Dec. 1, 2016, 7 pages.

United States Patent and Trademark Office, "Notice of Allowance," issued in connection with U.S. Appl. No. 15/229,920, dated Mar. 22, 2017, 7 pages.

United States Patent and Trademark Office, "Non-Final Office Action," issued in connection with U.S. Appl. No. 15/415,587, dated Aug. 4, 2017, 9 pages.

United States Patent and Trademark Office, "Notice of Allowance," issued in connection with U.S. Appl. No. 15/415,587, dated Jan. 19, 2018, 7 pages.

United States Patent and Trademark Office, "Non-Final Office Action," issued in connection with U.S. Appl. No. 15/634,974, dated Apr. 9, 2018, 7 pages.

United States Patent and Trademark Office, "Final Office Action," issued in connection with U.S. Appl. No. 15/634,974, dated Oct. 25, 2018, 8 pages.

United States Patent and Trademark Office, "Non-Final Office Action," dated Apr. 5, 2018 in connection with U.S. Appl. No. 15/657,548, 8 pages.

United States Patent and Trademark Office, "Non-Final Office Action," issued in connection with U.S. Appl. No. 15/261,178, dated Sep. 29, 2017, 11 pages.

United States Patent and Trademark Office, "Final Office Action," issued in connection with U.S. Appl. No. 15/261,178, dated Apr. 11, 2018, 12 pages.

United States Patent and Trademark Office, "Notice of Allowance," dated Aug. 3, 2018 in connection with U.S. Appl. No. 15/261,178, 5 pages.

United States Patent and Trademark Office, "Non-Final Office Action," dated Oct. 2, 2018, in connection with U.S. Appl. No. 15/786,405, 8 pages.

United States Patent and Trademark Office, "Notice of Allowance," issued in connection with U.S. Appl. No. 15/786,405, dated Feb. 1, 2019, 9 pages.

(56) References Cited

OTHER PUBLICATIONS

United States Patent and Trademark Office, "Non-Final Office Action," issued in connection with U.S. Appl. No. 15/261,191, dated Jan. 23, 2019, 10 pages.
United States Patent and Trademark Office, "Notice of Allowance," dated Jul. 1, 2019 in connection with U.S. Appl. No. 15/261,191, 7 pages.
United States Patent and Trademark Office, "Non-Final Office Action," issued in connection with U.S. Appl. No. 16/201,535, dated Jan. 25, 2019, 13 pages.
United States Patent and Trademark Office, "Non-Final Office Action," issued in connection with U.S. Appl. No. 16/201,535, dated Aug. 8, 2019, 11 pages.
United States Patent and Trademark Office, "Notice of Allowance," dated Sep. 21, 2018 in connection with U.S. Appl. No. 15/909,155, 8 pages.
United States Patent and Trademark Office, "Notice of Allowance," dated Oct. 23, 2018 in connection with U.S. Appl. No. 15/657,548, 8 pages.
State Intellectual Property Office of the People's Republic of China, "Notice of Allowance," dated Mar. 16, 2018 in connection with Chinese Patent Application No. 201720947684.5, 4 pages (full document and English translation).
State Intellectual Property Office of the People's Republic of China, "First Office Action," dated May 24, 2019 in connection with Chinese Patent Application No. 201710340752.6, 25 pages, translation not available.
United States Patent and Trademark Office, "Non-Final Office Action," dated Sep. 19, 2019 in connection with U.S. Appl. No. 15/415,594, 7 pages.
United States Patent and Trademark Office, "Restriction Requirement," dated Aug. 31, 2018 in connection with U.S. Appl. No. 15/261,191, 5 pages.
United States Patent and Trademark Office, "Non-Final Office Action," dated Oct. 2, 2019 in connection with U.S. Appl. No. 16/421,116, 7 pages.
China National Intellectual Property Administration (CNIPA), "First Office Action," dated Oct. 24, 2019, in connection with Chinese Patent Application No. 201810209272.0, 13 pages (Full document and English translation).
United States Patent and Trademark Office, "Notice of Allowance," dated Oct. 17, 2019 in connection with U.S. Appl. No. 15/261,191, 6 pages.
China National Intellectual Property Administration (CNIPA), "Notice of Allowance," dated Nov. 12, 2019 in connection with Chinese Patent Application No. 201710340752.6, 7 pages (full document and English translation).
United States Patent and Trademark Office, "Corrected Notice of Allowance," dated Dec. 26, 2019 in connection with U.S. Appl. No. 15/261,191, 3 pages.
United States Patent and Trademark Office, "Notice of Allowance," dated Feb. 6, 2020 in connection with US. Appl. No. 16/421,116, 7 pages.
United States Patent and Trademark Office, "Notice of Allowance," dated Feb. 27, 2020 in connection with U.S. Appl. No. 16/201,535, 8 pages.

* cited by examiner

QUADRILATERAL DISPLAY AND METHOD FOR FORMING THE SAME

FIELD OF THE DISCLOSURE

This disclosure relates generally to displays, methods of making displays, and mechanisms for maintaining such displays in an erect state.

BACKGROUND

Displays may be used at a point of purchase to provide advertising or other information on outer surfaces of a shroud defining a structure for the display.

BRIEF DESCRIPTION OF THE DRAWINGS

The figures are not to scale. Wherever possible, the same reference numbers will be used throughout the drawings and accompanying written description to refer to the same or like parts.

DETAILED DESCRIPTION

The examples disclosed herein relate to displays that can be used for point-of-sale advertising, providing information or for other suitable purposes. The example displays disclosed herein are configured to be collapsed to a folded, substantially flat state, which facilitates shipping and transport, and to be readily erected or deployed at a location (e.g., a point-of-sale, a conference booth, a store, etc.) to effect a desired display function.

In some examples disclosed herein, the example displays include one or more substrates (e.g., a sheet material, a panel, etc.) that, singly or in combination, form a shroud into which one or more internal support members are disposed or are able to be disposed. In some examples, the deployed shroud defines a generally quadrilateral cross-section which may approximate, for example, a rectangle, a square, a rhombus, a rhomboid, a trapezium or a trapezoid. In some examples, the substrate(s) can include card stock, paperboard and/or corrugated fiberboard.

A base structure is optionally attached to or integrated with one or more portions of the shroud, such as a base portion, to help to maintain the shroud in a desired orientation. In some examples, the base structure can include card stock, paperboard and/or corrugated fiberboard.

Figure 1:
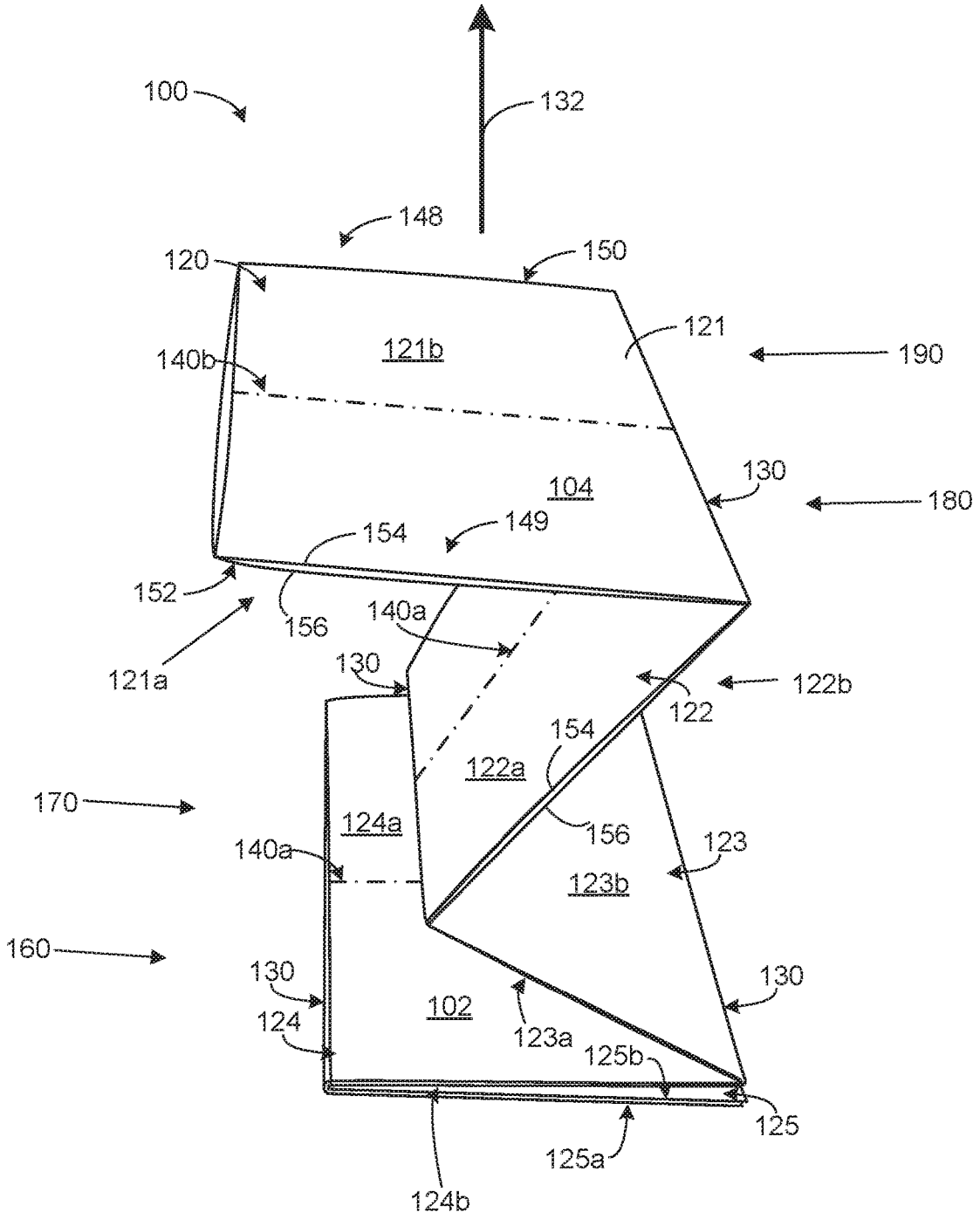
FIG. 1 is a perspective view of an example quadrilateral display, showing the example display transitioning from a folded state to an erected or deployed state in accordance with teachings herein.

Turning to the figures, FIG. 1 shows an example quadrilateral display 100 having an example shroud 120 that is formed of a first substrate 102 and a second substrate 104. In some examples, the shroud 120 can be formed from a single substrate, two substrates, three substrates, or four substrates. Each substrate may include n segments, where n is any number including, but not limited to, one segment, two segments, three segments, four segments, five segments (as shown) or more than five segments.

In the example of FIG. 1, the first substrate 102 includes five segments 121*a*, 122*a*, 123*a*, 124*a* and 125*a* and the second substrate 104 includes five segments 121*b*, 122*b*, 123*b*, 124*b* and 125*b*. Where the substrate (e.g., the first substrate 102, the second substrate 104, etc.) includes a plurality of segments, each segment is hinged to an adjacent segment a line of weakness 130 formed in the substrate to form a joint. Each line of weakness 130 is formed in the substrate(s) in substantially the same position along a height of the substrate so that the lines of weakness 130 of the substrate(s) are substantially vertically aligned with one another to facilitate folding of the shroud 120. In the example of FIG. 1, segment 121 is hinged to segment 122 by lines of weakness 130 formed in the first substrate 102 and in the second substrate 104. More particularly, a first line of weakness 130 joining segments 121*a* and 122*a* of the first substrate 102 is substantially vertically aligned with a line of weakness 130 joining segments 121*b* and 122*b* of the second substrate 104 so that the segments 121*a*, 121*b* and 122*a*, 122*b* fold about the respective lines of weakness 130 when the shroud 120 is to be collapsed to a substantially flat state. Thus, each of the segments 121-125 is rotatable relative an adjacent segment by a laterally-oriented joint (i.e., a line of weakness 130) formed between the segments and the segments 121-125 are foldable about the laterally-oriented joints to place the shroud 120 in the stowed position.

FIG. 1 shows, via the example arrow 132, that the example quadrilateral display 100 is transitioning from a folded or stowed state to an erected or deployed state. In FIG. 1, the segments 121-123 are partially unfolded relative to one another, while segments 124-125 are still in a folded state. The example quadrilateral display 100 can be collapsed or folded by reversing the operation depicted in FIG. 1 with each of the segments 121-125 being rotated about a line of weakness 130 relative to the adjoining segment(s). The example lines of weakness 130 enable the example quadrilateral display 100 to be folded to be relatively flat, with adjacent segments 121-125 of the shroud 120 being folding against one-another along the lines of weakness 130, such as in a multi-part z-fold, for example.

In FIG. 1, the first substrate 102 includes an example vertical line of weakness 140*a* and the second substrate 104 includes an example vertical line of weakness 140*b*. The first substrate 102 and the second substrate 104 are connected together at a first lateral side 148 and a second lateral side 149, respectively, to form a first joint 150 and a second joint 152. In some examples, the first substrate 102 and the second substrate 104 each include one or more connection members at the first lateral side 148 and include one or more connection members at the second lateral side 149 to permit connection to corresponding connection members of the opposing substrate to form the first joint 150 and the second joint 152. In some examples, connection members are formed at lateral portions of the first substrate 102 and the second substrate 104 via vertical lines of weakness, such as lines of weakness 154, 156 at the second lateral side 149 of the shroud 120 of FIG. 1, which permits lateral portions of the first substrate 102 and the second substrate 104 to be folded inwardly to define flaps serving as connection members.

In the example of FIG. 1, the first substrate 102 has a first section 160 (e.g., portions of segments 121*a*-125*a* on one side of the vertical line of weakness 140*a*) and a second section 170 (e.g., portions of segments 121*a*-125*a* on the other side of the vertical line of weakness 140*a*) with a third joint (e.g., line of weakness 140*a*) formed along an axial direction of the first substrate 102 between the first section 160 and the second section 170 to permit rotation of the first section 160 relative to the second section 170. Likewise, the second substrate 104 includes a third section 180 (e.g., portions of segments 121*b*-125*b* on one side of the vertical line of weakness 140*b*) and a fourth section 190 (e.g., portions of segments 121*b*-125*b* on the other side of the vertical line of weakness 140*b*) with a fourth joint (e.g., line of weakness 140*b*) formed along an axial direction of the second substrate 104 between the third section 180 and the fourth section 190 to permit rotation of the third section 180 relative to the fourth section 190. The first substrate 102 and the second substrate 104 are connected at the first joint 15 2 connecting the first section 160 of the first substrate 102 and the third section 180 of the second substrate 104 and the second joint 150 connecting the second section 170 of the first substrate 102 and the fourth section 190 of the second substrate 104.

Figure 2:
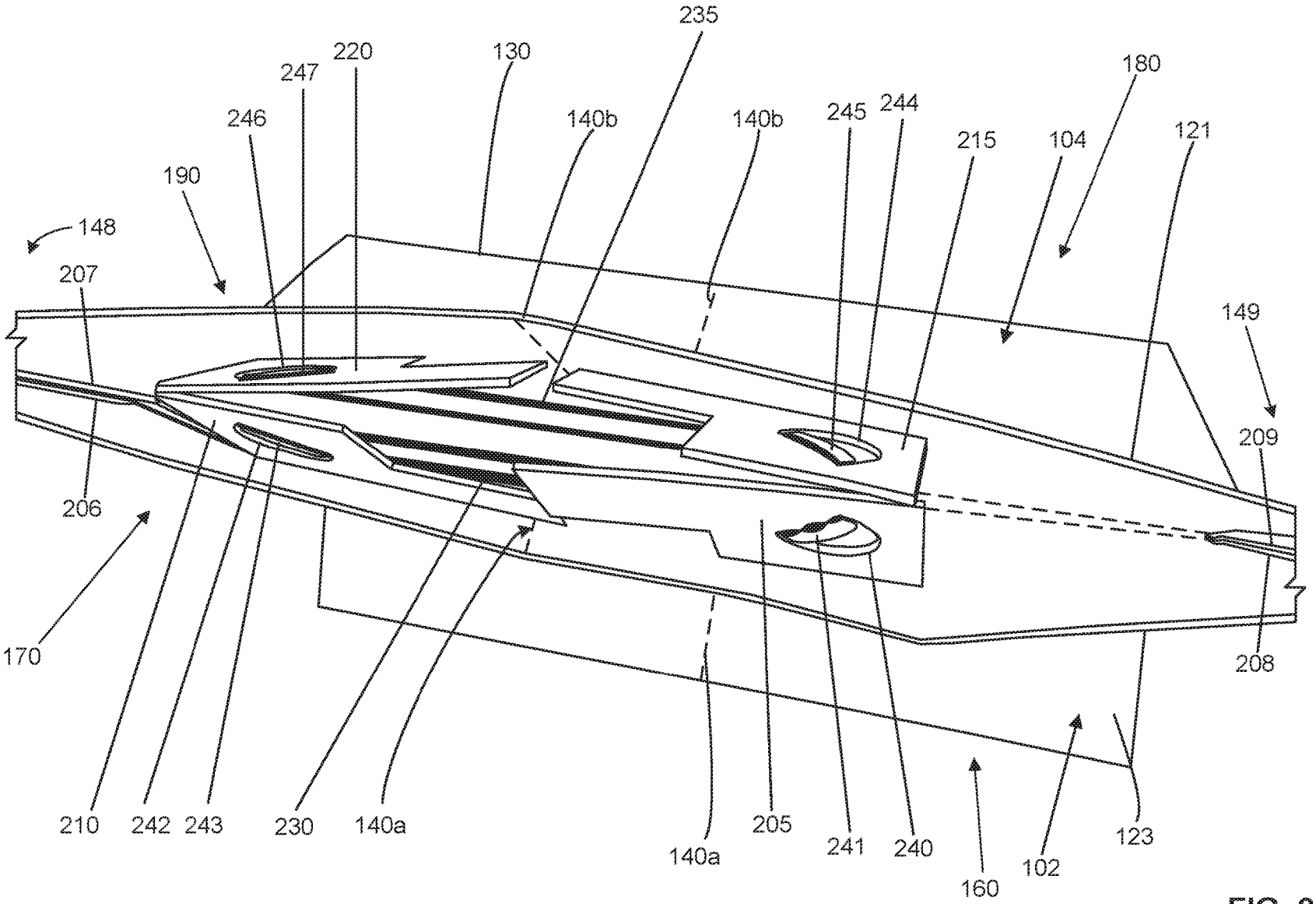
FIG. 2 is a perspective top view of the example quadrilateral display of FIG. 1, showing the example quadrilateral display in an intermediary position of deployment in accordance with teachings herein.

FIG. 2 is a perspective top view of the example quadrilateral display 100 of FIG. 1, showing the example quadrilateral display 100 in an intermediate position of deployment between a folded or stowed state and an unfolded and deployed state.

FIG. 2 shows an example connection member 206 formed at the first lateral side 148 of the first substrate 102 and an example connection member 208 formed at the second lateral side 149 of the first substrate 102. FIG. 2 also shows that the second substrate 104 includes an example connection member 207 formed at the first lateral side 148 and an example connection member 209 formed at the second lateral side 149. When the first substrate 102 and the second substrate 104 are placed in opposition to one another, the connection member (e.g., 206, FIG. 2) of the first substrate 102 is positioned adjacent to the connection member (e.g., 207, FIG. 2) of the second substrate 104 and the connection member 208 of the first substrate 102 is positioned adjacent to the connection member 209 of the second substrate 104. The connection member 206 of the first substrate 102 is then connected to the connection member 207 of the second substrate 104 to form the first joint 150 and the connection member 208 of the first substrate 102 is then connected to the connection member 209 of the second substrate 104 to form the second joint 152 and to form the shroud 120. In some examples, the connection members 206, 207 and/or the connection members 208, 209 are connected together via one or more connecting elements (e.g., elastic members, snap connectors, clips, hook-and-eye fasteners, hook-and-loop fasteners (e.g., VELCRO® brand fasteners, etc.), pins, snap fasteners, string, twist ties, staples, adhesives, thermal bonds, interlocking tabs, male/female connectors, etc.) to form the first joint 150 and the second joint 152.

As noted above, in some examples, the shroud 120 of the example quadrilateral display 100 is formed of a single substrate comprising n segments along an axial (height) direction of the substrate, where n is any number. In an example where the substrate includes a plurality of segments (i.e., two or more segments), each segment is hinged to the adjacent segment(s) by a line of weakness 130 formed in the substrate to form a joint between the adjacent segments, similar to the example of FIG. 1. The lines of weakness 130 in the substrate are formed laterally along the substrate as shown in FIG. 1. Vertical lines of weakness 140*a*, 140*b* are formed in the substrate (see, e.g., FIG. 1). Additionally, in the single substrate example, a vertical line of weakness (not shown) is formed in the substrate in lieu of the second joint 152 of FIG. 1. Similar to FIG. 1, the substrate includes an example connection member (e.g., 206, FIG. 2) formed at a first lateral side and an example connection member (e.g., 207, FIG. 2) formed at a second lateral side, which may be in the form of flaps defined by vertical lines of weakness in the substrate. When the example connection member formed at the first lateral side of the substrate is disposed in opposition to the example connection member formed at the second lateral side of the substrate, the connection member is then connected to the connection member to define the shroud 120. As with the example shroud 120 of FIG. 1 including the first substrate 102 and the second substrate 104, the connection member and the connection member of the single substrate quadrilateral display 100 are connected together via one or more connecting elements (e.g., elastic members, snap connectors, clips, hook-and-eye fasteners, hook-and-loop fasteners (e.g., VELCRO® brand fasteners, etc.), pins, snap fasteners, string, twist ties, staples, adhesives, thermal bonds, interlocking tabs, male/female connectors, etc.) to form the first joint 150.

FIG. 2 shows example anchors including an example first anchor 205 attached to the first section 160 of the first segment 121*a* of the first substrate 102, an example second anchor 210 attached to the second section 170 of the first segment 121*a* of the first substrate 102, an example third anchor 215 attached to the third section 180 of the first segment 121*b* of the second substrate 104 and an example fourth anchor 220 attached to the fourth section 190 of the first segment 121*b* of the second substrate 104. In some examples, the first anchor 205 and/or the second anchor 210 are attached to the first substrate 102 via an adhesive. In some examples, the third anchor 215 and/or the fourth anchor 220 are attached to the second substrate 104 via an adhesive.

In some examples, the first anchor 205 is rotatably attached to the first section 160 of the first substrate 102, the second anchor 210 is rotatably attached to the second section 170 of the first substrate 102, the third anchor 215 is rotatably attached to the third section 180 of the second substrate 104 and the fourth anchor 220 is rotatably attached to the fourth section 190 of the second substrate 104.

In some examples, the first substrate 102, the second substrate 104, the first anchor 205, the second anchor 210, the third anchor 215 and/or the fourth anchor 220 are formed from card stock, paperboard and/or corrugated fiberboard.

Figure 9:
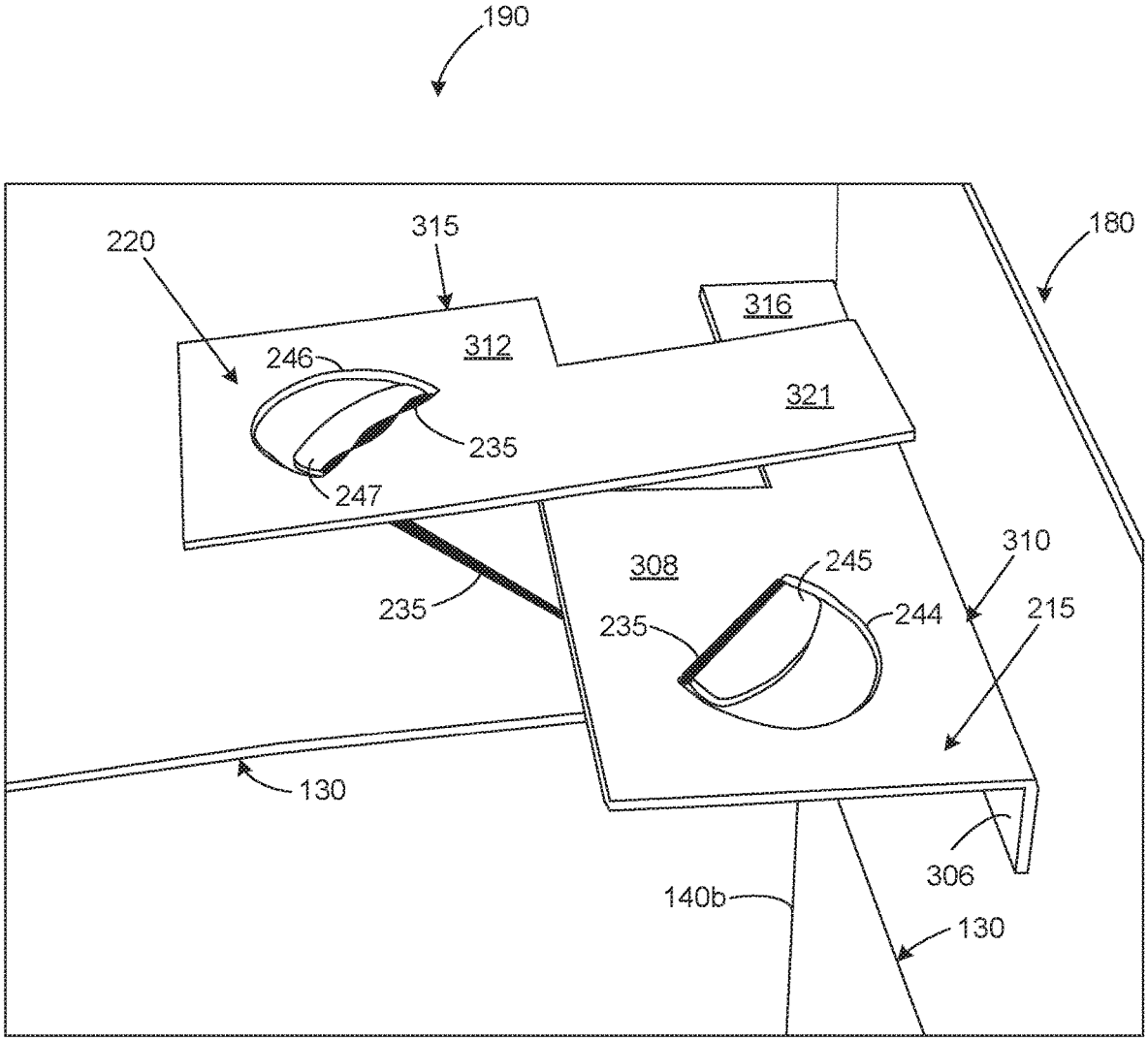
FIG. 9 is a perspective view of example anchors of the example quadrilateral display of FIGS. 1-8 in the deployed state, shown in FIGS. 7-8, in accordance with teachings herein.

In FIG. 2, an example first elastic member 230 (e.g., rubber bands, elastic bands, etc.) is connected to the first anchor 205 and the second anchor 210 to bias the first anchor 205 and the second anchor 210, and the attached first section 160 and second section 170, toward one another about the third joint or line of weakness 140*a* and toward a second position corresponding to a deployed position (see, e.g., FIG. 9). An example second elastic member 235 is shown to connect the third anchor 215 and the fourth anchor 220 to bias the third anchor 215 and the fourth anchor 220, and the attached third section 180 and fourth section 190, toward one another about the fourth joint or line of weakness 140*b* and toward the second position corresponding to a deployed position. The first elastic member 230 and the second elastic member 235 bias the shroud 120 from a stowed position to a deployed position with the first section 160, the second section 170, the third section 180 and the fourth section 190 forming a quadrilateral shape when the plurality of anchors 205, 210, 215, 220 are positioned in the second position. In the stowed position, the first anchor 205 is folded against the first section 160, the second anchor 210 is folded against the second section 170, the third anchor 215 is folded against the third section 180 and the fourth anchor 220 is folded against the fourth section 190.

In the state depicted in FIG. 2, the first substrate 102 and the second substrate 104 are still substantially folded and the first anchor 205, the second anchor 210, the third anchor 215 and the fourth anchor 220 and are close to a first position (e.g., folded upwardly against the first substrate 102 and the second substrate 104) within the shroud 120 corresponding to the position assumed by the first anchor 205, the second anchor 210, the third anchor 215 and the fourth anchor 220 when the shroud 120 is in a stowed position. In FIG. 2, the first anchor 205, the second anchor 210, the third anchor 215 and the fourth anchor 220, all disposed toward a top portion of the quadrilateral display 100, are shown to fold upwardly against the first substrate 102 and the second substrate 104 to assume the first position. In some examples, the first anchor 205, the second anchor 210, the third anchor 215 and the fourth anchor 220 fold downwardly against the first substrate 102 and the second substrate 104 to assume the stowed position. For instance, if the first anchor 205, the second anchor 210, the third anchor 215 and the fourth anchor 220 are disposed toward a bottom portion of the quadrilateral display 100, they may be disposed to fold downwardly against the first substrate 102 and the second substrate 104 to assume the stowed position.

FIG. 2 shows that the first anchor 205 includes an example first notch 240 defining an example first tab 241 about which a first end of the first elastic member 230 is attached and shows that the second anchor 210 includes an example second notch 242 defining an example second tab 243 about which a second end of the first elastic member 230 is attached. FIG. 2 also shows that the third anchor 215 includes an example third notch 244 defining an example third tab 245 about which a first end of the second elastic member 235 is attached and the fourth anchor 220 includes an example fourth notch 246 defining an example fourth tab 247 about which a second end of the second elastic member 235 is attached.

Figure 3:
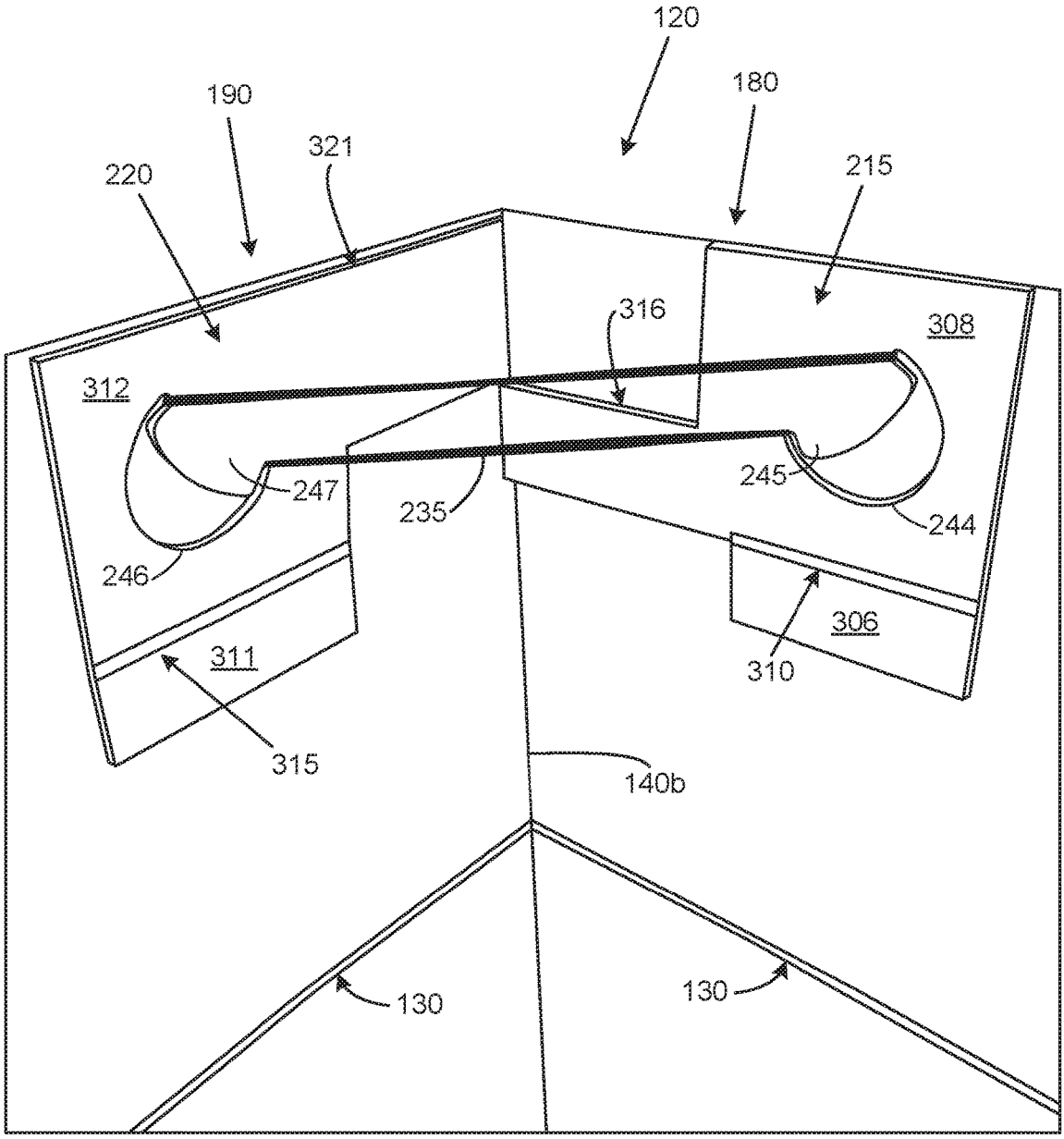
FIG. 3 is a perspective view of example anchors for the example quadrilateral display of FIGS. 1-2, with the example quadrilateral display being held open and the example anchors being held against the shroud of the example quadrilateral display in opposition to a bias applied by the example elastic member, in a position corresponding to a stowed state of the example quadrilateral display in accordance with teachings herein.

FIG. 3 is a perspective view of the third anchor 215 and the fourth anchor 220, wherein the shroud 120 is being manually held open and the example anchors being manually held against the second substrate 104 of the quadrilateral display 100 in opposition to a bias (e.g., a tensile force) applied by the elastic member 235 to the third anchor 215 and the fourth anchor 220 and to the second substrate 104 to which the third anchor 215 and the fourth anchor 220 are attached. The position of the third anchor 215 and the fourth anchor 220 against the second substrate 104 corresponds to a position of the third anchor 215 and the fourth anchor 220 in the stowed state of the example quadrilateral display 100. When the quadrilateral display 100 is folded substantially flat, and the angle of the third section 180 relative to the fourth section 190 about the line of weakness 140*b* approaches 180°, the elastic member 235 is stretched to a greater degree than that illustrated in FIG. 3 and the elastic member 235 correspondingly imparts to the third anchor 215 and the fourth anchor 220 a greater bias or tensile force than would be indicated by the example provided for illustration in FIG. 3.

In FIG. 3, the third anchor 215 includes an example first portion 306 attached to the third section 180 (e.g., attached via an adhesive, etc.) and an example second portion 308 rotatably connected to the first portion via an example line of weakness 310. FIG. 3 likewise shows the fourth anchor 220 to include an example first portion 311 attached to the fourth section 190 (e.g., attached via an adhesive, etc.) and an example second portion 312 rotatably connected to the first portion 311 via an example line of weakness 315. Similarly, although not shown in FIG. 3, the first anchor 205 includes an example first portion attached to the first section 160 and an example second portion rotatably connected to the first portion via an example line of weakness and the second anchor 210 includes an example first portion adhesively attached to the second section 170 and an example second portion rotatably connected to the first portion via an example line of weakness.

FIG. 3 shows that the second portion 308 of the third anchor 215 includes the notch 244 defining the tab 245 about which a first end of the elastic member 235 is attached and the second portion 312 of the fourth anchor 220 includes the fourth notch 246 defining a fourth tab 247 about which a second end of the first elastic member 235 is attached. Similarly, as shown in FIGS. 2-3, the second portion of the first anchor 205 includes the first notch 240 defining the first tab 241 about which a first end of the first elastic member 230 is attached and the second portion of the second anchor 210 includes the second notch 242 defining the second tab 243 about which a second end of the first elastic member 230 is attached.

FIG. 3 further shows that the third anchor 215 includes an example third portion 316 extending from the second portion 308 in a direction of the fourth section 190 and that the fourth anchor 220 includes an example third portion 321 extending from the second portion 312 in a direction of the third section 180.

Figure 4:
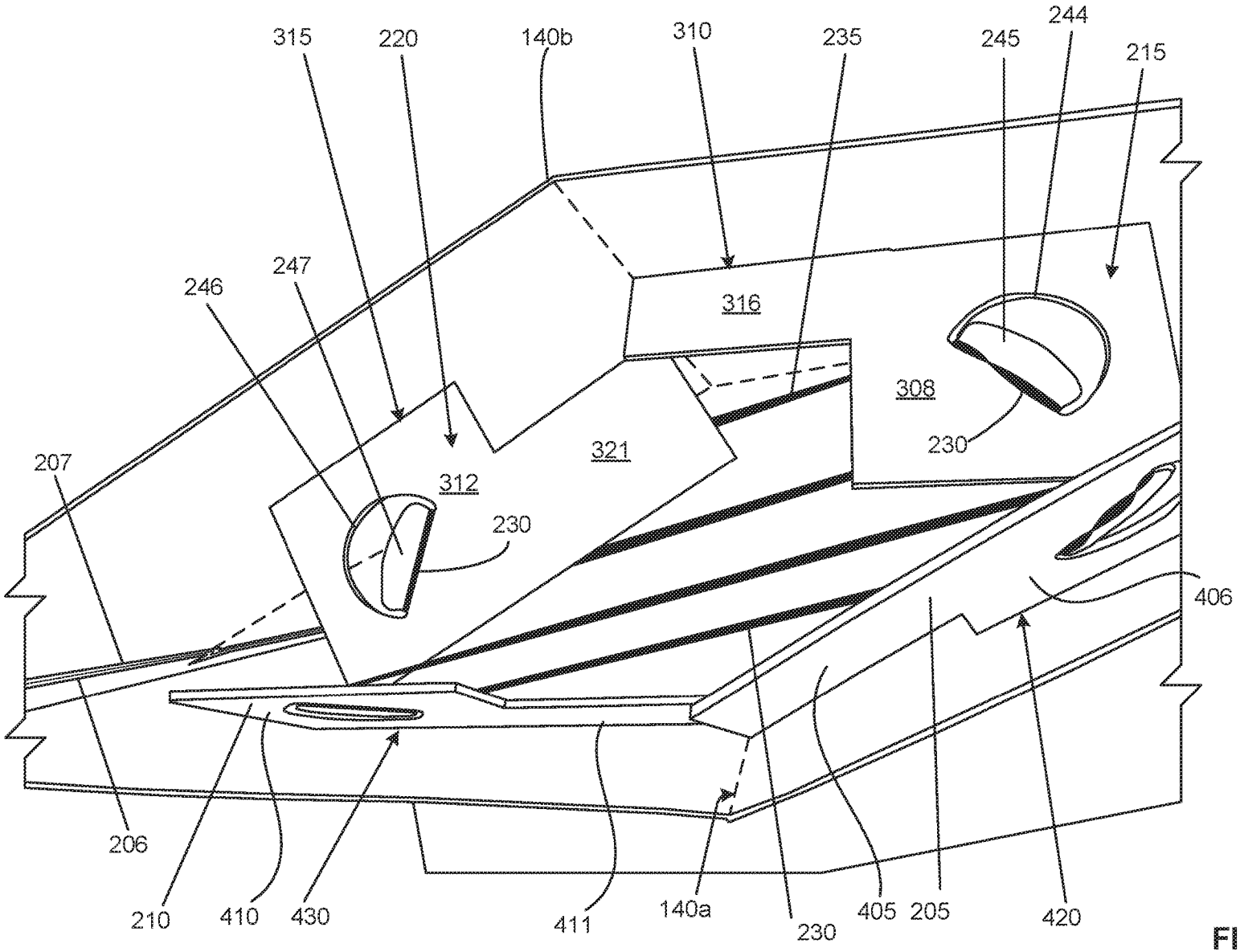
FIG. 4 is a perspective top view of the example quadrilateral display of FIG. 1 showing further movement of the example quadrilateral display from the intermediary position shown in FIG. 2 in a direction toward a deployed state in accordance with teachings herein.

FIG. 4 shows a perspective top view of the example quadrilateral display 100 of FIG. 1 in a state reflecting further movement of the example quadrilateral display 100 from the intermediary position shown in FIG. 2 in a direction toward a deployed state. In FIG. 4, the first anchor 205 is shown to include an example third portion 405 extending from the second portion 406 of the first anchor 205 in a direction of the second section 170 and the second anchor 210 is shown to include a third portion 411 extending from the second portion 410 in a direction of the first section 160. The second portion 406 of the first anchor 205 is connected to a first tab (not shown) via an example line of weakness 420, the first tab being attached to the first section 160 of the first substrate 102. The second portion 410 of the second anchor 210 is connected to a second tab (not shown) via an example line of weakness 430, the second tab being attached to the second section 170 of the first substrate 102.

Figure 5:
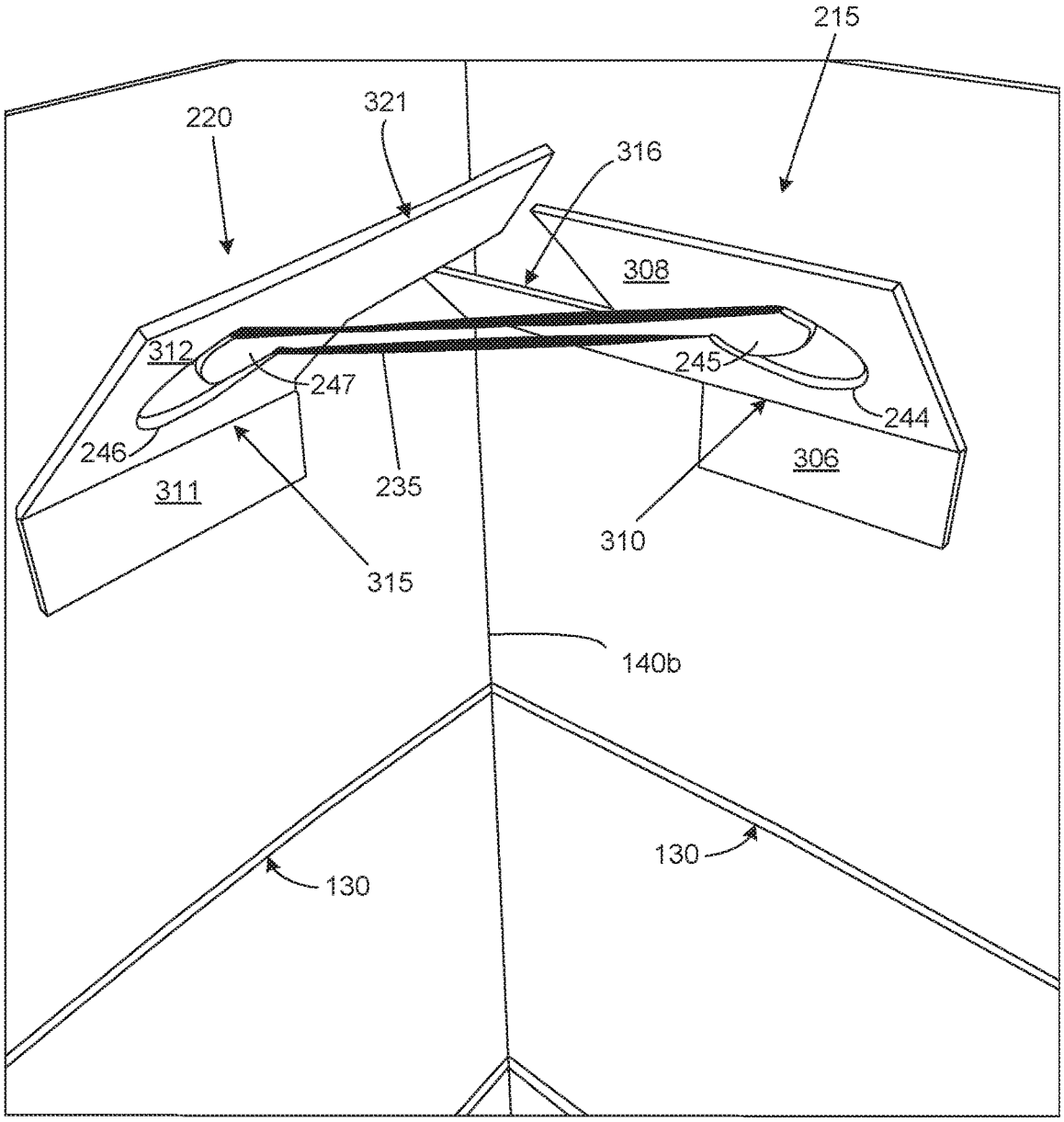
FIG. 5 is a perspective view of example anchors for the example quadrilateral display of FIGS. 1-4 between a stowed state and a deployed state of the example quadrilateral display in accordance with teachings herein.

FIG. 5 is a perspective view of the example quadrilateral display 100 of FIGS. 1-4 in an intermediary state between a stowed state and a deployed state. In FIG. 5, the second portion 308 of the third anchor 215 is partially rotated downward relative to the second section 170 about the line of weakness 310 and the second portion 312 of the fourth anchor 220 is partially rotated downward relative to the second section 170 about the line of weakness 315 responsive to the tensile force of the elastic member 235 applied, respectively, to the third anchor 215 via the third tab 245 in the third notch 244 and applied to the fourth anchor 220 via the fourth tab 247 in the fourth notch 247.

Figure 6:
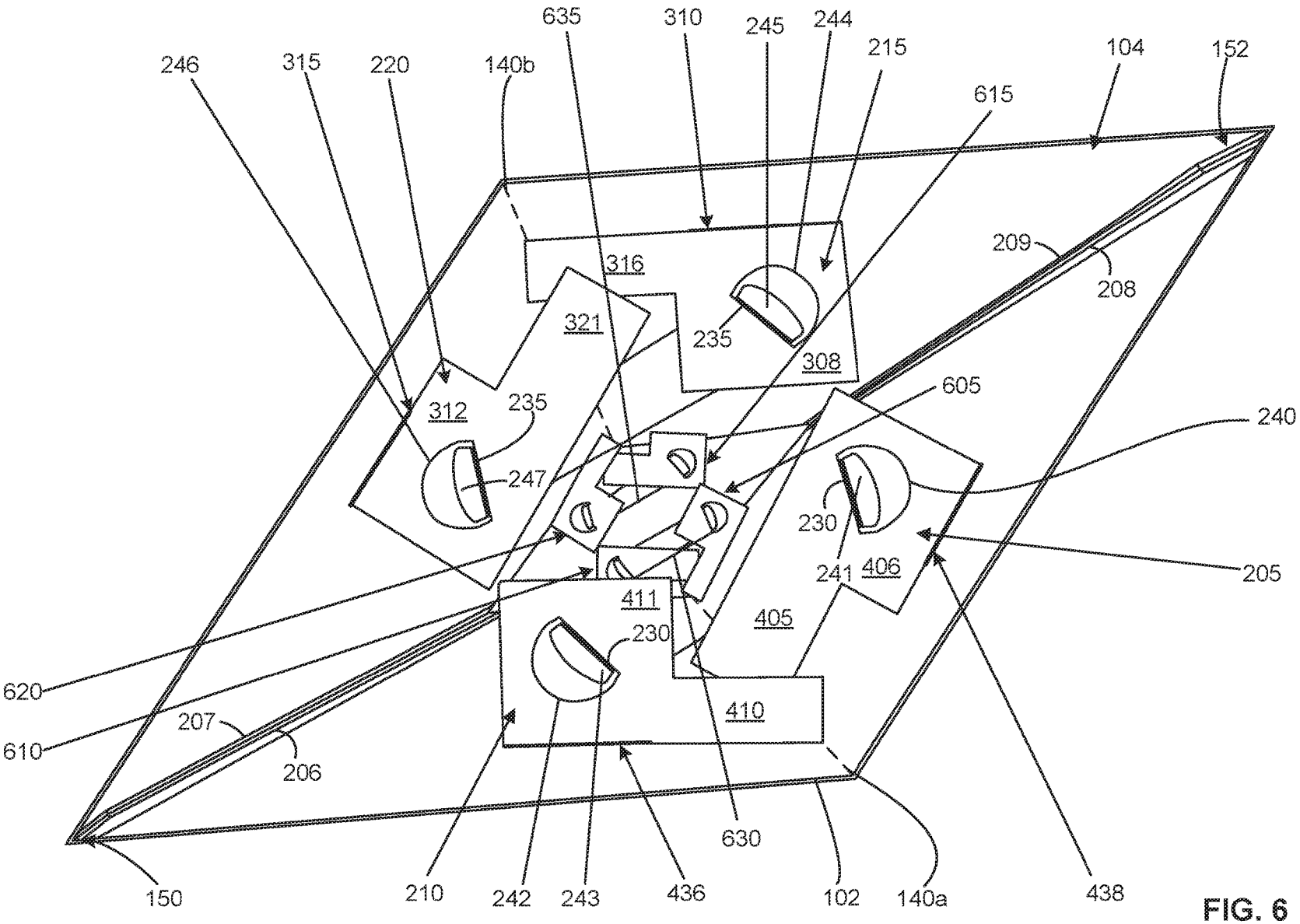
FIG. 6 is a perspective top view of the example quadrilateral display of FIGS. 1-5, showing further movement of the example quadrilateral display from the intermediary position shown in FIG. 4 in a direction toward a deployed state in accordance with teachings herein.

FIG. 6 is a perspective top view of the quadrilateral display 100 of FIGS. 1-7, showing further movement of the quadrilateral display 100 from the intermediary position shown in FIG. 4, to another intermediary position, in a direction toward a deployed state. FIG. 6 shows the connection member 206 of substrate 102 and the connection member 207 of substrate 104 forming the first joint 150 and the connection member 208 of substrate 102 and the connection member 209 of substrate 104 forming the second joint 152. FIG. 6 also shows the first anchor 205, the second anchor 210, the third anchor 215, and the fourth anchor 220 attached to an interior of the shroud 120 in the first segment 121, the topmost segment in the quadrilateral display 100. FIG. 6 also shows an example fifth anchor 605 attached to the first section 160 in the segment 125, an example sixth anchor 610 attached to the second section 170 in the segment 125, an example seventh anchor 615 attached to the third section 180 in the segment 125 and an example eighth anchor 620 attached to the fourth section 190 in the segment 125. An elastic member 630 connects the fifth anchor 605 and the sixth anchor 610 to bias the first section 160 and the second section 170 in the segment 125 toward one another about the first joint 150. An elastic member 635 connects the seventh anchor 615 and the eighth anchor 620 to bias the third section 180 and the fourth section 190 in the segment 125 toward one another about the second joint 152. The elastic members bias the shroud 120 from a stowed position to a deployed position.

Figure 7:
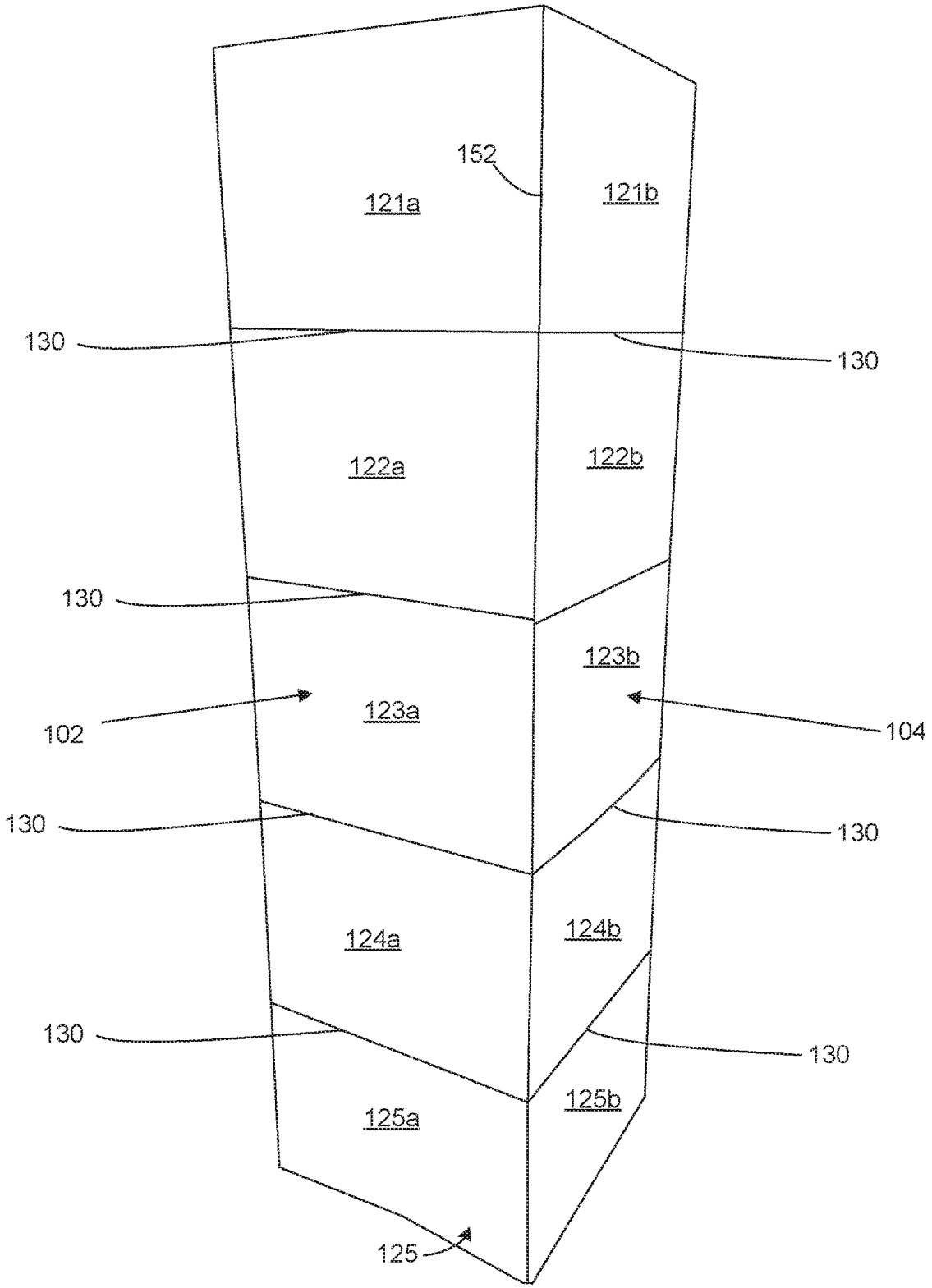
FIG. 7 is a perspective exterior view of the example quadrilateral display of FIGS. 1-6 in a deployed state in accordance with teachings herein.

FIG. 7 is a perspective exterior view of the quadrilateral display 100 of FIGS. 1-6 in a deployed state showing the five segments 121*a*, 122*a*, 123*a*, 124*a* and 125*a* of the first substrate 102 and five segments 121*b*, 122*b*, 123*b*, 124*b* and 125*b* of the second substrate 104, each of the segments being hinged to an adjacent segment a line of weakness 130 formed in the respective substrate 102, 104 to form a joint. The lines of weakness 130 are shown to be formed in the substrates 102, 104 in substantially the same position along a height of the substrate so that the lines of weakness 130 of the substrates 102, 104 are substantially vertically aligned with one another to facilitate folding of the shroud 120.

Figure 8:
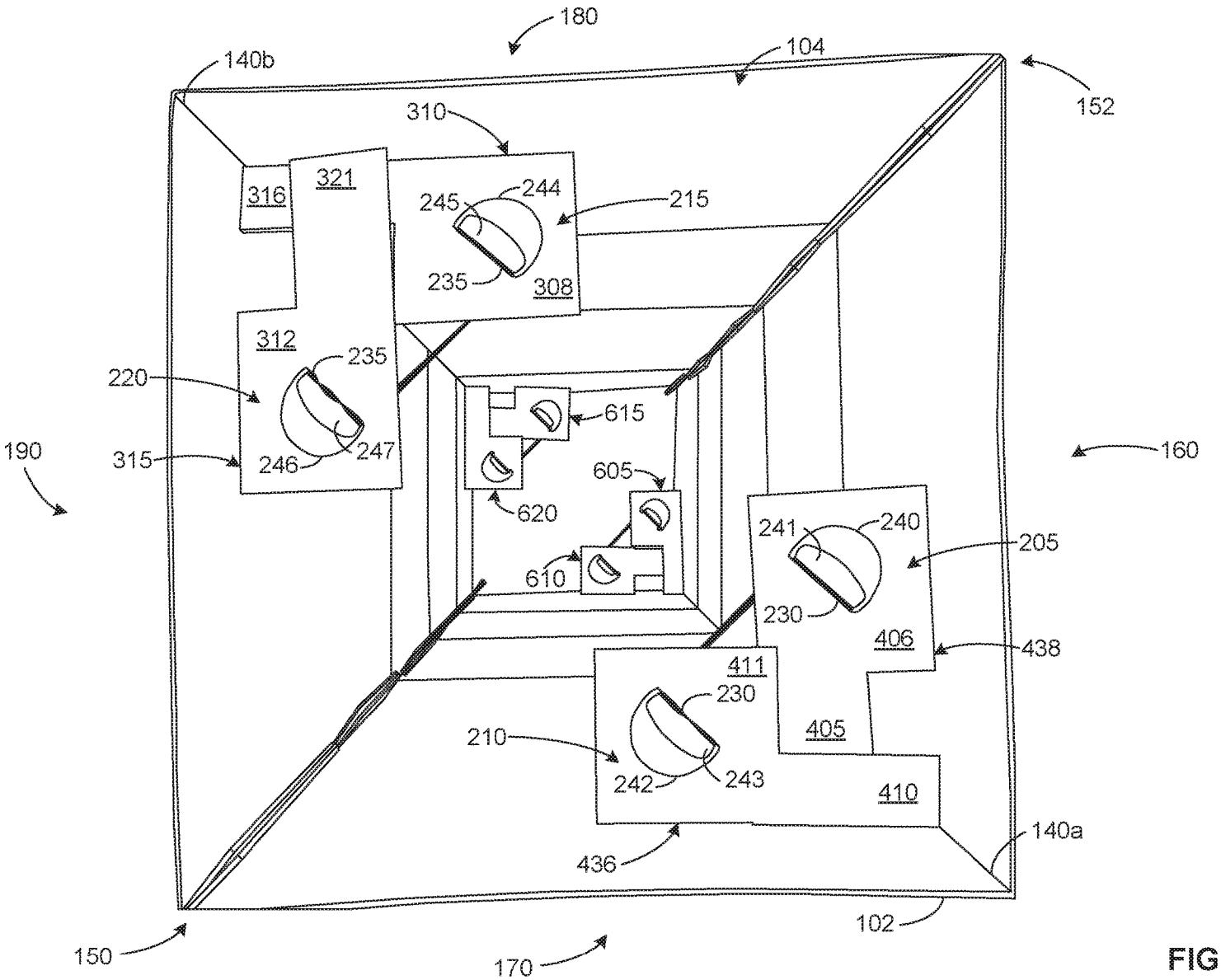
FIG. 8 is a top down view of the example quadrilateral display of FIGS. 1-7 in the deployed state in accordance with teachings herein.

FIG. 8 is a top down view of the quadrilateral display 100 of FIG. 7 in the deployed state. As shown in FIG. 8, the third portion 405 of the first anchor 205 contacts the second section 170 to stop rotation of the first section 160 about the third joint (e.g., line of weakness 140*a*) responsive to the bias of the first elastic member 230 and the third portion 410 of the second anchor 210 contacts the first section 160 to stop rotation of the second section 170 about the third joint 140*a* responsive to the bias of the first elastic member 230. Likewise, the third portion 316 of the third anchor 215 contacts the fourth section 190 to stop rotation of the third section 180 about the fourth joint (e.g., line of weakness 140*b*) responsive to the bias of the second elastic member 235 and the third portion 321 of the fourth anchor 220 contacts the third section 180 to stop rotation of the fourth section 190 about the fourth joint (e.g., line of weakness 140*b*) responsive to the bias of the second elastic member 235.

In the deployed position of the quadrilateral display 100 of FIG. 8, the first anchor 205 is substantially perpendicular to the first section 160, the second anchor 210 is substantially perpendicular to the second section 170, the third anchor 215 is substantially perpendicular to the third section 180 and the fourth anchor 220 is substantially perpendicular to the fourth section 190. During rotation of the first anchor 205 and the second anchor 210 from the stowed position (see, e.g., FIG. 3) to the deployed position (see, e.g., FIG. 8), the third portion 405 of the first anchor 205 and the third portion 410 of the second anchor 215 do not interfere with one another during rotation of the first anchor 205 and the second anchor 210 from the stowed position to the deployed position. Likewise, during rotation of the third anchor 215 and the fourth anchor 220 from the stowed position to the deployed position, the third portion 316 of the third anchor 215 and the third portion 321 of the fourth anchor 220 do not interfere with one another during rotation of the third anchor 215 and the fourth anchor 220 from the stowed position to the deployed position.

In some examples, the third portion 405 of the first anchor 205, the third portion 410 of the second anchor 215, the third portion 316 of the third anchor 215 and the third portion 321 of the fourth anchor 220 can be omitted, with the second portion 406 of the first anchor 205 and the second portion 411 of the second anchor 210 contacting one another to stop rotation of the first section 160 and the second section 170 about the third joint (e.g., line of weakness 140*a*), responsive to the bias of the first elastic member 230, at the deployed position. In such example, the second portion 308 of the third anchor 215 and the second portion 312 of the fourth anchor 220 respectively contact one another to stop rotation of the third section 180 and the fourth section 190 about the second joint (e.g., line of weakness 140*b*) responsive to the bias of the second elastic member 235, at the deployed position. By extension, in some examples, the fifth anchor 605, the sixth anchor 610, the seventh anchor 615 and the eighth anchor 620 can be similarly configured.

FIG. 9 is a perspective view of the third anchor 215 and the fourth anchor 220 of the quadrilateral display 100 of FIGS. 7-8 in the deployed state. In the deployed position of the quadrilateral display 100 in FIG. 9, the third portion 316 of the third anchor 215 and the third portion 321 of the fourth anchor 220 respectively contact the fourth section 190 and the third section 180 to stop rotation of the third section 180 and the fourth section 190 about the second joint (e.g., line of weakness 140*b*), responsive to the bias of the second elastic member 235, at the deployed position. In some examples, the third anchor 215 is substantially perpendicular to the third section 180 and the fourth anchor 220 is substantially perpendicular to the fourth section 190 in the deployed position. Likewise, in some examples, the first anchor 205 is substantially perpendicular to the first section 160, the second anchor 210 is substantially perpendicular to the second section 170, the fifth anchor 605 is substantially perpendicular to the first section 160, the sixth anchor 610 is substantially perpendicular to the second section 170, the seventh anchor 615 is substantially perpendicular to the third section 180 and/or the eighth anchor 620 is substantially perpendicular to the fourth section 190.

Figure 10:
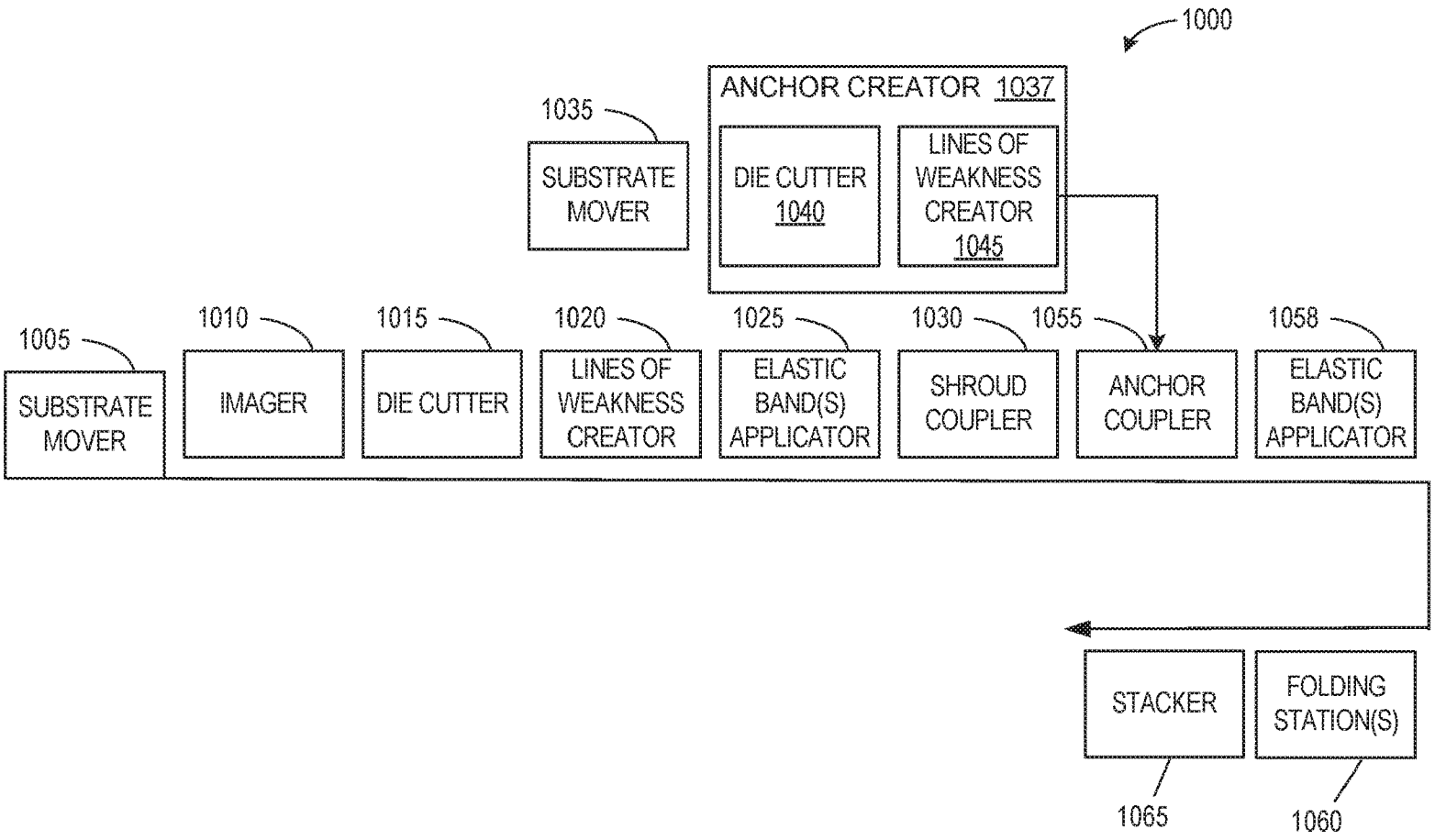
FIG. 10 illustrates an example apparatus that can be used to produce the example quadrilateral displays disclosed herein.

FIG. 10 represents an example apparatus 1000 that can be used to produce the example quadrilateral display 100. In some examples, the apparatus 1000 performs an in-line process that includes processes to produce the example shroud 120 in accordance with the teachings of this disclosure, example processes to produce the example anchor creator 1037 in accordance with the teachings of this disclosure and processes to produce the example quadrilateral display 100. While the processes disclosed below are described in connection with automatic processes, any and/or all of the processes disclosed may instead be implemented manually.

In the illustrated example, the example apparatus 1000 includes elements to produce the example shroud 120 and/or the example quadrilateral display 100, including, for example, a substrate mover 1005, an imager 1010, a die cutter 1015, a lines of weakness creator 1020, an elastic band applicator 1025, a shroud coupler 1030, an anchor coupler 1055, an elastic band applicator 1058, a folding station 1060, and a stacker 1065. Feeding into the anchor coupler 1055 are anchors output from the anchor creator 1037 which receives a substrate from the substrate mover 1035 and forms the anchors using a die cutter 1040 and a lines of weakness creator 1045. In some examples, the die cutter 1040 produces two configurations of anchor, such as the example third anchor 215 and the example fourth anchor 220 shown in FIGS. 2-9.

To produce the example shroud 120 in accordance with the teachings of this disclosure, in some examples, the substrate mover 1005 feeds one or more pieces of substrate and/or a web of substrate into the apparatus 1000.

In some examples, the imager 1010 images a first and/or a second side of the example shroud blank(s) and/or substrate(s) (e.g., 102, 104). The images may include brand-related images and/or text, advertising-related images and/or text, point-of-purchase-related images and/or text, instructional images and/or text, and/or any other desired indicia.

The die cutter 1015 forms one or more features and/or notches within the shroud and/or elongate substrates 102, 104, including, for example, grooves and/or notches on more connection members (e.g., 206, 207, 208, 209) of the substrates 102, 104 to facilitate connection of the more connection members (e.g., flaps, etc.) to form the shroud 120. In some examples, the die cutter 1015 forms elongate substrates 102, 104 from continuous stock.

The lines weakness creator 1020 forms one or more lines weakness on the first and/or second sides of the shroud blank and/or the elongate substrates 102, 104 using one or more die(s), one or more cutting tool(s), one or more scoring tool(s), or one or more slotting tool(s). For example, the lines of weakness creator 1020 may form the axial lines of weakness 140*a*, 140*b* (see, e.g., FIGS. 1-2) defining the first section 160, the second section 170, the third section 180 and the fourth section 190 of the substrates 102, 104. The lines of weakness creator 1020 may also form additional axial lines of weakness defining the connection members 206, 208 of the first substrate 102 and the connection members 207, 209 of the second substrate 104. The lines of weakness creator 1020 may also form the lateral axial lines of weakness 130 (see, e.g., FIG. 1, FIG. 7) defining the five segments 121*a*, 122*a*, 123*a*, 124*a* and 125*a* of the first substrate 102 and defining the five segments 121*b*, 122*b*, 123*b*, 124*b* and 125*b* of the second substrate 104.

An example elastic band applicator 1025 couples one or more elastic bands to, or adjacent to, one or more connection members 206, 207, 208, 209 of the substrates 102, 104. In some examples, the elastic band applicator 1025 couples one or more elastic bands between the pairs of grooves of the connection members 206, 207, 208, 209 to connect the substrates 102, 104 via the connection members 206, 207, 208, 209.

In some examples, to produce an example anchor (e.g., the first anchor 205, etc.), the substrate mover 1035 feeds one more pieces of substrate and/or a web of substrate into the apparatus 1000.

The example die cutter 1040 forms one or more anchors (e.g., the third anchor 215, the fourth anchor 220, etc.) from an example web. The example lines of weakness creator 1045 forms the lines of weakness (e.g., 310, 315) in the anchor substrate (e.g., the third anchor 215, the fourth anchor 220, etc.) using one or more die(s), one or more cutting tool(s), one or more scoring tool(s) or one or more slotting tool(s).

In some examples, the shroud coupler 1030 forms the quadrilateral display 100 shroud by folding the connection members 206, 208 of a first substrate (e.g., 102) about axial lines weakness formed by the lines of weakness creator 1020 and folding the connection members 207, 209 of a second substrate (e.g., 104) about lines of weakness formed by the lines of weakness creator 1020 and by coupling respective pairs of inwardly facing and opposing flaps (e.g., 206, 207) via grooves formed in the substrate via die cutter 1015 using elastic members provided by the elastic bands applicator 1025.

The example anchor coupler 1055 couples an example anchor (e.g., the third anchor 215, etc.) within the interior of the example shroud 120 by positioning the anchor relative to the respective substrate (e.g., substrate 104) and adhesively securing a first portion of the anchor (e.g., first portion 306) to an interior portion of the substrate (e.g., substrate 104).

The example elastic band applicator 1058 couples a first elastic band 230 to the first tab 241 of the first notch 240 and to the second tab 242 of the second notch 242 and couples a second elastic band 235 to the third tab 245 of the third notch 244 and the fourth tab 247 of the fourth notch 246.

The folding station 1060 flattens and/or folds the quadrilateral display 100 along the longitudinal axes of the shroud 120 and/or folds the quadrilateral display about the transverse axes of the shroud, along the line(s) of weakness 130, for storage and/or shipping. The stacker 1065 stacks the quadrilateral displays 100 for storage and/or shipping. In some examples, one or more of the processes implemented by the apparatus 1000, the elastic band applicator 1025, the shroud coupler 1030, the anchor creator 1037, th4 anchor coupler 1055, the elastic band applicator 1058, the folding station 1060 and/or the stacker 1065 in FIG. 10 are performed manually.

While the stations and/or portions, including the example substrate mover 1005, the example imager 1010, the example die cutter 1015, the example lines of weakness creator 1020, the example elastic band applicator 1025, the example shroud coupler 1030, the example substrate mover 1035, the example anchor creator 1037, the example die cutter 1040, the example lines of weakness creator 1045, the example anchor coupler 1055, the example elastic band applicator 1058, the example folding station 1060 and/or the example stacker 1065, are depicted in a particular order, the stations and/or portions, including the example substrate mover 1005, the example imager 1010, the example die cutter 1015, the example lines of weakness creator 1020, the example elastic band applicator 1025, the example shroud coupler 1030, the example substrate mover 1035, the example anchor creator 1037, the example die cutter 1040, the example lines of weakness creator 1045, the example anchor coupler 1055, the example elastic band applicator 1058, the example folding station 1060 and/or the example stacker 1065 of the apparatus 1000, may be implemented in any other way.

For example, the order of the stations and/or portions including the example substrate mover 1005, the example imager 1010, the example die cutter 1015, the example lines of weakness creator 1020, the example elastic band applicator 1025, the example shroud coupler 1030, the example substrate mover 1035, the example anchor creator 1037, the example die cutter 1040, the example lines of weakness creator 1045, the example anchor coupler 1055, the example elastic band applicator 1058, the example folding station 1060 and/or the example stacker 1065 of the apparatus 1000 may be changed, and/or some of the example substrate mover 1005, the example imager 1010, the example die cutter 1015, the example lines of weakness creator 1020, the example elastic band applicator 1025, the example shroud coupler 1030, the example substrate mover 1035, the example anchor creator 1037, the example die cutter 1040, the example lines of weakness creator 1045, the example anchor coupler 1055, the example elastic band applicator 1058, the example folding station 1060 and/or the example stacker 1065 of the apparatus 1000 may be changed, eliminated, or combined. For example, while the apparatus 1000 is depicted as having a die cutter 1015 separate from a lines of weakness creator 1020, in some examples, the die cutter 1015 and the lines of weakness creator 1020 may be combined. Likewise, while the apparatus 1000 is depicted as having a die cutter 1040 separate from a lines of weakness creator 1045, in some examples, the die cutter 1040 and the lines of weakness creator 1045 may be combined.

Figure 11:
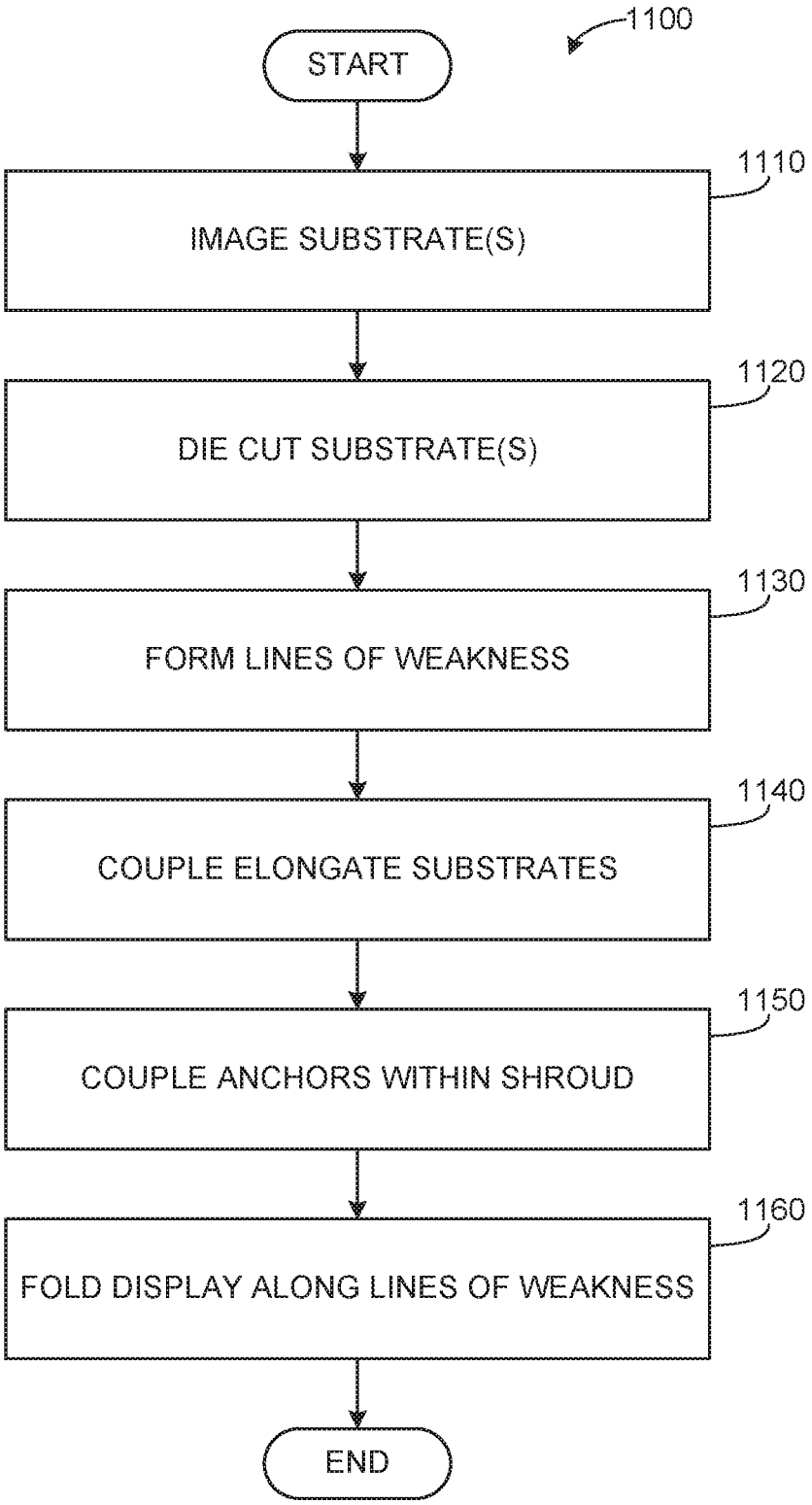
FIG. 11 illustrates a flowchart representative of machine-readable instructions that may be executed to implement the apparatus of FIG. 10.

A flowchart representative of example machine-readable instructions for implementing the apparatus of FIG. 10 is shown in FIG. 11. In this example, the machine-readable instructions comprise a program for execution by a processor such as the processor 1212, shown in the example processor platform 1200 discussed below in connection with FIG. 12. The program may be embodied in software stored on a tangible computer-readable storage medium such as a CD-ROM, a floppy disk, a hard drive, a digital versatile disk (DVD), a Blu-ray disk, or a memory associated with the processor 1212, but the entire program and/or parts thereof could alternatively be executed by a device other than the processor 1212 and/or embodied in firmware or dedicated hardware. Further, although the example program is described with reference to the flowchart illustrated in FIG. 11, many other methods of implementing the example apparatus 1000 of FIG. 10 may alternatively be used. For example, the order of execution of the blocks may be changed, and/or some of the blocks described may be changed, eliminated, or combined.

As mentioned above, the example processes of FIG. 12 may be implemented using coded instructions (e.g., computer and/or machine-readable instructions) stored on a tangible computer-readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term "tangible computer-readable storage medium" is expressly defined to include any type of computer-readable storage device and/or storage disk and to exclude propagating signals and transmission media. As used herein, "tangible computer-readable storage medium" and "tangible machine-readable storage medium" are used interchangeably. Additionally or alternatively, the example processes of FIG. 12 may be implemented using coded instructions (e.g., computer and/or machine-readable instructions) stored on a non-transitory computer and/or machine-readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term "non-transitory computer-readable medium" is expressly defined to include any type of computer-readable storage device and/or storage disk and to exclude propagating signals and transmission media. As used herein, when the phrase "at least" is used as the transition term in a preamble of a claim, it is open-ended in the same manner as the term "comprising" is open-ended.

The process 1100 of FIG. 11 includes imaging a substrate (e.g., the elongated substrates) (block 1110) using, for example, the imager 1010 that images a first and/or second side of the elongated substrate(s) 102, 104 and/or a first and/or a second side of a substrate from which the substrates 102, 104 are to be formed. The imaging may include, for example, brand-related images and/or text, advertising-related images and/or text, point-of-purchase-related images and/or text, instructional images and/or other text, indicia and/or images.

The substrates are die cut at block 1120 using, for example, the first die cutter 1015 to form the substrates 102, 104 and to form features in the substrates 102, 104, such as, but not limited to, the connection members 206, 207, 208, 209 and/or grooves or notches therein. In some examples, block 1120 includes using the die cutter 1040 to form the anchors (e.g., first anchor 205, etc.).

In block 1130, lines of weakness (e.g., 130, 140*a*, 140*b*, etc. in FIG. 1, etc.) are formed in the substrate(s) (e.g., substrates 102, 104) and/or the anchors (e.g., line of weakness 310 in the third anchor 215, etc.) using, for example, the first lines of weakness creator 1020 and/or second lines of weakness creator 1045 via one or more die(s), one or more cutting tool(s), one or more scoring tool(s) or one or more slotting tool(s).

In block 1140, the elongate substrates 102, 104 are coupled. In some examples, the connection members 206, 207, 208, 209 of the elongate substrates 102, 104 are folded about the axial lines of weakness to form inwardly facing connection members 206, 208 (substrate 102) and connection members 207, 209 (substrate 104) and an elastic band applicator 1025 applies elastic bands to couple the adjacent and opposing connection members (e.g., 206, 207 and 208, 209) of the substrates 102, 104 to define the shroud. In some examples, the connection members 206, 207, 208, 209 of the elongate substrates 102, 104 are coupled via an adhesive or physical attachment members (e.g., staples, etc.). In some examples, the shroud coupler 1030 is used to couple two elongate substrates together (e.g., 102, 104 in FIG. 2). In some examples, the shroud coupler 1030 couples side edges of a single substrate together, with an additional line of weakness formed in lieu of the first joint 150.

In block 1150, one or more example anchors (e.g., the first anchor 205, the second anchor 210, etc.) are coupled within the shroud defined by the elongate substrates 102, 104 in block 1140 using, for example, the anchor coupler 1055 to couple anchors within the interior of the shroud, such as via an adhesive connection, thus completing the formation of the example quadrilateral display 100. In some examples, the anchor coupler 1055, or other device, folds the one or more example anchors (e.g., the third anchor 215, the fourth anchor 220, etc.) inwardly over the example first portions (e.g., the first portion 306, the first portion 311, etc.) to weaken or work the lines of weakness (e.g., line of weakness 310, lines of weakness 315, etc.) to facilitate deployment via the elastic member(s) (e.g., the second elastic member 235, etc.).

In block 1160, the formed quadrilateral display 100 is folded along lines of weakness (e.g., lines of weakness 130 in substrates 102, 104) using, for example, the folding station 1060 that flattens and/or folds the quadrilateral display 100 about transverse axes of the shroud, such as along lines of weakness 130, for storage and/or shipping. The folded quadrilateral displays 100 are then stacked using, for example, the stacker 1065 to stack the quadrilateral display 100 for storage and/or shipping.

Figure 12:
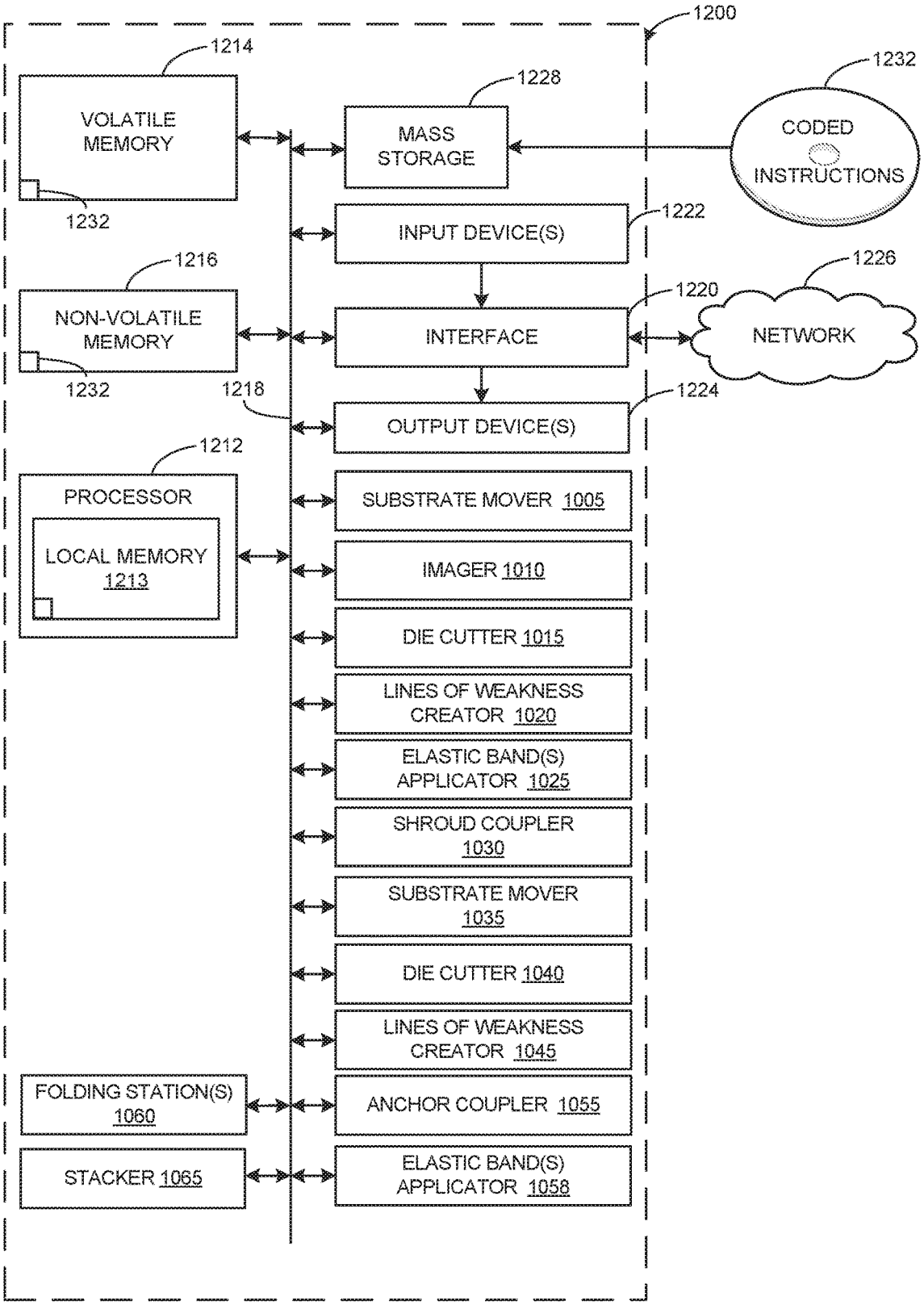
FIG. 12 illustrates a processor platform to execute the instructions of FIG. 11 to implement the apparatus of FIG. 10.

FIG. 12 is a block diagram of an example processor platform 1200 capable of executing the instructions of FIG. 11 to implement the apparatus 1000 of FIG. 10 to control operation of one or more of the example substrate mover 1005, the example imager 1010, the example die cutter 1015, the example lines of weakness creator 1020, the example elastic band applicator 1025, the example shroud coupler 1030, the example substrate mover 1035, the example anchor creator 1037, the example die cutter 1040, the example lines of weakness creator 1045, the example anchor coupler 1055, the example elastic band applicator 1058, the example folding station 1060 and/or the example stacker 1065. The processor platform 1200 can be, for example, a server, a personal computer, a mobile device (e.g., a tablet such as an iPad™), an Internet appliance or any other type of computing device.

The processor platform 1200 of the illustrated example includes a processor 1212. The processor 1212 of the illustrated example is hardware. For example, the processor 1212 can be implemented by one or more integrated circuits, logic circuits, microprocessors or controllers from any desired family or manufacturer.

The processor 1212 of the illustrated example includes a local memory 1213 (e.g., a cache). The processor 1212 of the illustrated example is in communication with a main memory including a volatile memory 1214 and a non-volatile memory 1216 via a bus 1218. The volatile memory 1214 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1216 may be implemented by flash memory and/or any other desired type of memory device. Access to the main memory 1214, 1216 is controlled by a memory controller.

The processor platform 1200 of the illustrated example also includes an interface circuit 1220. The interface circuit 1220 may be implemented by any type of interface standard, such as an Ethernet interface, a universal serial bus (USB), and/or a PCI express interface.

In the illustrated example, one or more input devices 1222 are connected to the interface circuit 1220. The input device(s) 1222 permit(s) a user to enter data and commands into the processor 1212. The input device(s) can be implemented by, for example, an audio sensor, a microphone, a camera (still or video), a keyboard, a button, a mouse, a touchscreen, a track-pad, a trackball and/or a voice recognition system.

One or more output devices 1224 are also connected to the interface circuit 1220 of the illustrated example. The output devices 1224 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1220 of the illustrated example, thus, typically includes a graphics driver card, a graphics driver chip or a graphics driver processor.

The interface circuit 1220 of the illustrated example also includes a communication device such as a transmitter, a receiver, a transceiver, a modem and/or network interface card to facilitate exchange of data with external machines (e.g., computing devices of any kind) via a network 1226 (e.g., an Ethernet connection, a digital subscriber line (DSL), a telephone line, coaxial cable, a cellular telephone system, etc.).

The processor platform 1200 of the illustrated example also includes one or more mass storage devices 1228 for storing software and/or data. Examples of such mass storage devices 1228 include floppy disk drives, hard drive disks, compact disk drives, Blu-ray disk drives, RAID systems, and digital versatile disk (DVD) drives.

The coded instructions 1232 of FIG. 12 may be stored in the mass storage device 1228, in the volatile memory 1214, in the non-volatile memory 1216, and/or on a removable tangible computer readable storage medium such as a CD or DVD.

Example 1 is a quadrilateral display including a shroud formed from a first substrate and a second substrate, the first substrate having a first section and a second section with a first joint formed along an axial direction of the first substrate between the first section and the second section to permit rotation of the first section relative to the second section and the second substrate having a third section and a fourth section with a second joint formed along an axial direction of the second substrate between the third section and the fourth section to permit rotation of the third section relative to the fourth section, the first substrate and the second substrate being connected at a third joint connecting the first section of the first substrate and the third section of the second substrate and a fourth joint connecting the second section of the first substrate and the fourth section of the second substrate. The quadrilateral display includes a plurality of anchors including a first anchor attached to the first section, a second anchor attached to the second section, a third anchor attached to the third section and a fourth anchor attached to the fourth section, the plurality of anchors being disposed in a first position within the shroud in a stowed position and a second position within the shroud in a deployed position. The quadrilateral display includes a first elastic member connecting the first anchor and the second anchor to bias the first anchor and the second anchor, and the attached first section and second section, toward one another about the first joint and toward the second position and includes a second elastic member connecting the third anchor and the fourth anchor to bias the third anchor and the fourth anchor, and the attached third section and fourth section, toward one another about the second joint and toward the second position. The first elastic member and the second elastic member bias the shroud from a stowed position to a deployed position with the first section, the second section, the third section and the fourth section forming a quadrilateral shape when the plurality of anchors are positioned in the second position.

Example 2 includes the quadrilateral display of Example 1, wherein at least one of the first anchor, the second anchor, the third anchor or the fourth anchor are formed from at least one of card stock, paperboard or corrugated fiberboard.

Example 3 includes the quadrilateral display of Examples 1-2, wherein the first anchor is rotatably attached to the first section, the second anchor is rotatably attached to the second section, the third anchor is rotatably attached to the third section and the fourth anchor is rotatably attached to the fourth section.

Example 4 includes the quadrilateral display of Examples 1-3, wherein the first anchor includes a first portion adhesively attached to the first section and a second portion rotatably connected to the first portion via a line of weakness, wherein the second anchor includes a first portion adhesively attached to the second section and a second portion rotatably connected to the first portion via a line of weakness, wherein the third anchor includes a first portion adhesively attached to the third section and a second portion rotatably connected to the first portion via a line of weakness, and wherein the fourth anchor includes a first portion adhesively attached to the fourth section and a second portion rotatably connected to the first portion via a line of weakness.

Example 5 includes the quadrilateral display of Examples 1-4, wherein the second portion of the first anchor includes a first notch defining a first tab about which a first end of the first elastic member is attached, and wherein the second portion of the second anchor includes a second notch defining a second tab about which a second end of the first elastic member is attached.

Example 6 includes the quadrilateral display of Examples 1-5, wherein the second portion of the third anchor includes a third notch defining a third tab about which a first end of the second elastic member is attached, and wherein the second portion of the fourth anchor includes a fourth notch defining a fourth tab about which a second end of the second elastic member is attached.

Example 7 includes the quadrilateral display of Examples 1-6, wherein the first anchor includes a third portion extending from the second portion in a direction of the second section, wherein the second anchor includes a third portion extending from the second portion in a direction of the first section, wherein the third anchor includes a third portion extending from the second portion in a direction of the fourth section, and wherein the fourth anchor includes a third portion extending from the second portion in a direction of the third section.

Example 8 includes the quadrilateral display of Examples 1-7, wherein the third portion of the first anchor and the third portion of the second anchor respectively contact the second section and the first section to stop rotation of the first section and the second section about the first joint, responsive to the bias of the first elastic member, at the deployed position, and wherein the third portion of the third anchor and the third portion of the fourth anchor respectively contact the fourth section and the third section to stop rotation of the third section and the fourth section about the second joint, responsive to the bias of the second elastic member, at the deployed position.

Example 9 includes the quadrilateral display of Examples 1-8, wherein, in the stowed position, the first anchor is folded against the first section, the second anchor is folded against the second section, the third anchor is folded against the third section and the fourth anchor is folded against the fourth section.

Example 10 includes the quadrilateral display of Examples 1-9, wherein, in the deployed position, the first anchor is substantially perpendicular to the first section, the second anchor is substantially perpendicular to the second section, the third anchor is substantially perpendicular to the third section and the fourth anchor is substantially perpendicular to the fourth section.

Example 11 includes the quadrilateral display of Examples 1-10, wherein, in the stowed position, the first anchor is folded against the first section with the third portion of the first anchor disposed at a first axial position along a height of the shroud, the second anchor is folded against the second section with the third portion of the second anchor disposed at a second axial position along the height of the shroud, the third anchor is folded against the third section with the third portion of the third anchor disposed at the second axial position along the height of the shroud and the fourth anchor is folded against the fourth section with the third portion of the fourth anchor disposed at the first axial position along the height of the shroud, wherein the third portion of the first anchor and the third portion of the second anchor do not interfere with one another during rotation of the first anchor and the second anchor from the stowed position to the deployed position, and wherein the third portion of the third anchor and the third portion of the fourth anchor do not interfere with one another during rotation of the third anchor and the fourth anchor from the stowed position to the deployed position.

Example 12 includes the quadrilateral display of Examples 1-11, wherein the second portion of the first anchor and the second portion of the second anchor contact one another to stop rotation of the first section and the second section about the first joint, responsive to the bias of the first elastic member, at the deployed position, and wherein the second portion of the third anchor and the second portion of the fourth anchor respectively contact one another to stop rotation of the third section and the fourth section about the second joint, responsive to the bias of the second elastic member, at the deployed position.

Example 13 includes the quadrilateral display of Examples 1-12, wherein the shroud is formed from at least one of card stock, paperboard or corrugated fiberboard.

Example 14 includes the quadrilateral display of Examples 1-13, wherein the shroud includes, along a height of the shroud, a plurality of segments, wherein each of the plurality of segments is rotatable relative an adjacent segment by a laterally-oriented joint formed between each of the plurality of segments and the adjacent segment, and wherein the plurality of segments of the shroud are foldable about the laterally-oriented joints to place the shroud in the stowed position.

Example 15 includes the quadrilateral display of Examples 1-14, wherein the first anchor, the second anchor, the third anchor and the fourth anchor are disposed in a first segment, wherein the plurality of anchors includes a fifth anchor attached to the first section in a second segment, a sixth anchor attached to the second section in the second segment, a seventh anchor attached to the third section in the second segment and an eighth anchor attached to the fourth section in the second segment, wherein a third elastic member connects the fifth anchor and the sixth anchor to bias the first section and the second section in the second segment toward one another about the first joint, wherein a fourth elastic member connects the seventh anchor and the eighth anchor to bias the third section and the fourth section in the second segment toward one another about the second joint, and wherein the third elastic member and the fourth elastic member bias the shroud from a stowed position to a deployed position.

Example 16 is a quadrilateral display, comprising a shroud including a substrate, the substrate including a first section, a second section, a third section, and a fourth section and including a first joint formed along an axial direction of the substrate between the first section and the second section to permit rotation of the first section relative to the second section, a second joint formed along an axial direction of the substrate between the second section and the third section to permit rotation of the second section relative to the third section, a third joint formed along an axial direction of the substrate between the third section and the fourth section to permit rotation of the third section relative to the fourth section, and a fourth joint formed along an axial direction of the substrate between the fourth section and the first section to permit rotation of the fourth section relative to the first section, the fourth joint formed by a connection between the first section and the fourth section. The quadrilateral display also includes a plurality of anchors including a first anchor attached to the first section, a second anchor attached to the second section, a third anchor attached to the third section and a fourth anchor attached to the fourth section, the plurality of anchors being disposed in a first position within the shroud in a stowed position and a second position within the shroud in a deployed position. The quadrilateral display also includes a first elastic member connecting the first anchor and the second anchor to bias the first anchor and the second anchor, and the attached first section and second section, toward one another about the first joint and toward the second position and a second elastic member connecting the third anchor and the fourth anchor to bias the third anchor and the fourth anchor, and the attached third section and fourth section, toward one another about the second joint and toward the second position. The first elastic member and the second elastic member bias the shroud from a stowed position to a deployed position with the first section, the second section, the third section and the fourth section forming a quadrilateral shape when the plurality of anchors are positioned in the second position.

Example 17 includes the quadrilateral display of Example 16, wherein at least one of the first anchor, the second anchor, the third anchor or the fourth anchor are formed from at least one of card stock, paperboard or corrugated fiberboard.

Example 18 includes the quadrilateral display of Examples 16-17, wherein the first anchor is rotatably attached to the first section, the second anchor is rotatably attached to the second section, the third anchor is rotatably attached to the third section and the fourth anchor is rotatably attached to the fourth section.

Example 19 includes the quadrilateral display of Examples 16-18, wherein the first anchor includes a first portion adhesively attached to the first section and a second portion rotatably connected to the first portion via a line of weakness, wherein the second anchor includes a first portion adhesively attached to the second section and a second portion rotatably connected to the first portion via a line of weakness, wherein the third anchor includes a first portion adhesively attached to the third section and a second portion rotatably connected to the first portion via a line of weakness, and wherein the fourth anchor includes a first portion adhesively attached to the fourth section and a second portion rotatably connected to the first portion via a line of weakness.

Example 20 includes the quadrilateral display of Examples 16-19, wherein the second portion of the first anchor includes a first notch defining a first tab about which a first end of the first elastic member is attached, and wherein the second portion of the second anchor includes a second notch defining a second tab about which a second end of the first elastic member is attached.

Example 21 includes the quadrilateral display of Examples 16-20, wherein the second portion of the third anchor includes a third notch defining a third tab about which a first end of the second elastic member is attached, and wherein the second portion of the fourth anchor includes a fourth notch defining a fourth tab about which a second end of the first elastic member is attached.

Example 22 includes the quadrilateral display of Examples 16-21, wherein the first anchor includes a third portion extending from the second portion in a direction of the second section, wherein the second anchor includes a third portion extending from the second portion in a direction of the first section, wherein the third anchor includes a third portion extending from the second portion in a direction of the fourth section, and wherein the fourth anchor includes a third portion extending from the second portion in a direction of the third section.

Example 23 includes the quadrilateral display of Examples 16-22, wherein the third portion of the first anchor and the third portion of the second anchor respectively contact the second section and the first section to stop rotation of the first section and the second section about the first joint, responsive to the bias of the first elastic member, at the deployed position, and wherein the third portion of the third anchor and the third portion of the fourth anchor respectively contact the fourth section and the third section to stop rotation of the third section and the fourth section about the second joint, responsive to the bias of the second elastic member, at the deployed position.

Example 24 includes the quadrilateral display of Examples 16-23, wherein, in the stowed position, the first anchor is folded against the first section, the second anchor is folded against the second section, the third anchor is folded against the third section and the fourth anchor is folded against the fourth section.

Example 25 includes the quadrilateral display of Examples 16-24, wherein, in the deployed position, the first anchor is substantially perpendicular to the first section, the second anchor is substantially perpendicular to the second section, the third anchor is substantially perpendicular to the third section and the fourth anchor is substantially perpendicular to the fourth section.

Example 26 includes the quadrilateral display of Examples 16-25, wherein, in the stowed position, the first anchor is folded against the first section with the third portion of the first anchor disposed at a first axial position along a height of the shroud, the second anchor is folded against the second section with the third portion of the second anchor disposed at a second axial position along the height of the shroud, the third anchor is folded against the third section with the third portion of the third anchor disposed at the second axial position along the height of the shroud and the fourth anchor is folded against the fourth section with the third portion of the fourth anchor disposed at the first axial position along the height of the shroud, wherein the third portion of the first anchor and the third portion of the second anchor do not interfere with one another during rotation of the first anchor and the second anchor from the stowed position to the deployed position, and wherein the third portion of the third anchor and the third portion of the fourth anchor do not interfere with one another during rotation of the third anchor and the fourth anchor from the stowed position to the deployed position.

Example 27 includes the quadrilateral display of Examples 16-26, wherein the second portion of the first anchor and the second portion of the second anchor contact one another to stop rotation of the first section and the second section about the first joint, responsive to the bias of the first elastic member, at the deployed position, and wherein the second portion of the third anchor and the second portion of the fourth anchor respectively contact one another to stop rotation of the third section and the fourth section about the second joint, responsive to the bias of the second elastic member, at the deployed position.

Example 28 includes the quadrilateral display of Examples 16-27, wherein the shroud is formed from at least one of card stock, paperboard or corrugated fiberboard.

Example 29 includes the quadrilateral display of Examples 16-28, wherein the shroud includes, along a height of the shroud, a plurality of segments, wherein each of the plurality of segments is rotatable relative an adjacent segment by a laterally-oriented joint formed between each of the plurality of segments and the adjacent segment, and wherein the plurality of segments of the shroud are foldable about the laterally-oriented joints to place the shroud in the stowed position.

Example 30 includes the quadrilateral display of Examples 16-29, wherein the first anchor, the second anchor, the third anchor and the fourth anchor are disposed in a first segment, wherein the plurality of anchors includes a fifth anchor attached to the first section in a second segment, a sixth anchor attached to the second section in the second segment, a seventh anchor attached to the third section in the second segment and an eighth anchor attached to the fourth section in the second segment, wherein a third elastic member connects the fifth anchor and the sixth anchor to bias the first section and the second section in the second segment toward one another about the first joint, wherein a fourth elastic member connects the seventh anchor and the eighth anchor to bias the third section and the fourth section in the second segment toward one another about the second joint, and wherein the third elastic member and the fourth elastic member bias the shroud from the stowed position to the deployed position.

Example 31 is a quadrilateral display comprising a shroud including a first section, a second section, a third section and a fourth section, the first section, the second section, the third section and the fourth section being rotatably disposed relative to adjacent ones of the first section, the second section, the third section and the fourth section, a plurality of anchors including a first anchor attached to the first section, a second anchor attached to the second section, a third anchor attached to the third section and a fourth anchor attached to the fourth section, the plurality of anchors being disposed in a first position within the shroud in a stowed position and a second position within the shroud in a deployed position. The quadrilateral display includes a first elastic member connecting the first anchor and the second anchor to bias the first anchor and the second anchor, and the attached first section and second section, toward one another about the first joint and toward the second position and a second elastic member connecting the third anchor and the fourth anchor to bias the third anchor and the fourth anchor, and the attached third section and fourth section, toward one another about the second joint and toward the second position. The first elastic member and the second elastic member bias the shroud from a stowed position to a deployed position with the first section, the second section, the third section and the fourth section forming a quadrilateral shape when the plurality of anchors are positioned in the second position.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A quadrilateral display, comprising:

a shroud formed from a first substrate and a second substrate, the first substrate having a first section and a second section with a first joint formed along an axial direction of the first substrate between the first section and the second section to permit rotation of the first section relative to the second section, the second substrate having a third section and a fourth section with a second joint formed along an axial direction of the second substrate between the third section and the fourth section to permit rotation of the third section relative to the fourth section, the first substrate and the second substrate connected at a third joint connecting the first section of the first substrate and the third section of the second substrate, the first substrate and the second substrate connected at a fourth joint connecting the second section of the first substrate and the fourth section of the second substrate, the first substrate opposite the second substrate, the first joint opposite the second joint, the third joint opposite the fourth joint, the first section, the second section, the third section and the fourth section forming four sides of a quadrilateral, and the first joint, the second joint, the third joint, and the fourth joint forming four corners of the quadrilateral when the shroud is in a deployed position;

a plurality of anchors including a first anchor attached to the first section, a second anchor attached to the second section, a third anchor attached to the third section and a fourth anchor attached to the fourth section, the plurality of anchors being disposed in a first position within the shroud in a stowed position and a second position within the shroud in the deployed position, the first anchor separate from the second anchor, the third anchor separate from the fourth anchor;

a first elastic member connecting the first anchor and the second anchor to bias the first anchor and the second anchor toward one another about the first joint and toward the second position; and a second elastic member connecting the third anchor and the fourth anchor to bias the third anchor and the fourth anchor toward one another about the second joint and toward the second position, and wherein the first elastic member and the second elastic member bias the shroud from the stowed position to the deployed position.

2. The quadrilateral display according to claim 1, wherein at least one of the first anchor, the second anchor, the third anchor or the fourth anchor are L-shaped.

3. The quadrilateral display according to claim 1, wherein the first anchor is rotatably attached to the first section, the second anchor is rotatably attached to the second section, the third anchor is rotatably attached to the third section and the fourth anchor is rotatably attached to the fourth section.

4. The quadrilateral display according to claim 1, wherein the first anchor includes a first portion adhesively attached to the first section and a second portion rotatably connected to the first portion via a first line of weakness, the first line of weakness orthogonal to the axial direction, wherein the second anchor includes a first portion adhesively attached to the second section and a second portion rotatably connected to the first portion via a second line of weakness, the second line of weakness orthogonal to the axial direction, wherein the third anchor includes a first portion adhesively attached to the third section and a second portion rotatably connected to the first portion via a third line of weakness, the third line of weakness orthogonal to the axial direction, and wherein the fourth anchor includes a first portion adhesively attached to the fourth section and a second portion rotatably connected to the first portion via a fourth line of weakness, the fourth line of weakness orthogonal to the axial direction.

5. The quadrilateral display according to claim 4, wherein the second portion of the first anchor includes a first notch defining a first tab about which a first end of the first elastic member is attached, and wherein the second portion of the second anchor includes a second notch defining a second tab about which a second end of the first elastic member is attached.

6. The quadrilateral display according to claim 5, wherein the second portion of the third anchor includes a third notch defining a third tab about which a first end of the second elastic member is attached, and wherein the second portion of the fourth anchor includes a fourth notch defining a fourth tab about which a second end of the second elastic member is attached.

7. The quadrilateral display according to claim 6, wherein the second portion of the first anchor and the second portion of the second anchor contact one another to stop rotation of the first section and the second section about the first joint, responsive to the bias of the first elastic member, at the deployed position, and wherein the second portion of the third anchor and the second portion of the fourth anchor contact one another to stop rotation of the third section and the fourth section about the second joint, responsive to the bias of the second elastic member, at the deployed position.

8. The quadrilateral display according to claim 4, wherein the first anchor includes a rectangular third portion extending from the second portion in a direction of the second section, the third portion of the first anchor having a smaller width than the second portion, wherein the second anchor includes a rectangular third portion extending from the second portion in a direction of the first section, the third portion of the second anchor having a smaller width than the second portion, wherein the third anchor includes a rectangular third portion extending from the second portion in a direction of the fourth section, the third portion of the third anchor having a smaller width than the second portion, and wherein the fourth anchor includes a rectangular third portion extending from the second portion in a direction of the third section, the third portion of the fourth anchor having a smaller width than the second portion.

9. The quadrilateral display according to claim 1, wherein the shroud is formed from at least one of card stock, paperboard or corrugated fiberboard.

10. The quadrilateral display according to claim 1, wherein the shroud includes, along a height of the shroud, a plurality of segments, wherein each of the plurality of segments is rotatable relative an adjacent segment by a laterally-oriented joint formed between each of the plurality of segments and the adjacent segment, and wherein the plurality of segments of the shroud are foldable about the laterally-oriented joints to place the shroud in the stowed position.

11. A quadrilateral display, comprising:

a shroud including:

a substrate, the substrate including a first section, a second section, a third section, and a fourth section, a first joint formed along an axial direction of the substrate between the first section and the second section to permit rotation of the first section relative to the second section, a second joint formed along an axial direction of the substrate between the second section and the third section to permit rotation of the second section relative to the third section, a third joint formed along an axial direction of the substrate between the third section and the fourth section to permit rotation of the third section relative to the fourth section, and a fourth joint formed along an axial direction of the substrate between the fourth section and the first section to permit rotation of the fourth section relative to the first section, the fourth joint formed by a connection between the first section and the fourth section;

a plurality of anchors including a first anchor attached to the first section between the first joint and the fourth joint, a second anchor attached to the second section between the first joint and the third joint, a third anchor attached to the third section between the second joint and the third joint, and a fourth anchor attached to the fourth section between the second joint and the fourth joint, the plurality of anchors being disposed in a first position within the shroud in a stowed position and a second position within the shroud in a deployed position, the first anchor separate from the second anchor, and the third anchor separate from the fourth anchor;

a first elastic member connecting the first anchor and the second anchor to bias the first anchor and the second anchor toward one another about the first joint and toward the second position;

a second elastic member connecting the third anchor and the fourth anchor to bias the third anchor and the fourth anchor toward one another about the second joint and toward the second position, wherein the first elastic member and the second elastic member bias the shroud from the stowed position to the deployed position with the first section, the second section, the third section and the fourth section forming a quadrilateral shape when the plurality of anchors are positioned in the second position.

12. The quadrilateral display according to claim 11, wherein the first anchor, the second anchor, the third anchor, and the fourth anchor are a same shape.

13. The quadrilateral display according to claim 11, wherein the first anchor is rotatably attached to the first section, the second anchor is rotatably attached to the second section, the third anchor is rotatably attached to the third section and the fourth anchor is rotatably attached to the fourth section.

14. The quadrilateral display according to claim 11, wherein the first anchor includes a first portion adhesively attached to the first section and a second portion rotatably connected to the first portion via a first line of weakness, wherein the second anchor includes a first portion adhesively attached to the second section and a second portion rotatably connected to the first portion via a second line of weakness, wherein the third anchor includes a first portion adhesively attached to the third section and a second portion rotatably connected to the first portion via a third line of weakness, and wherein the fourth anchor includes a first portion adhesively attached to the fourth section and a second portion rotatably connected to the first portion via a fourth line of weakness.

15. The quadrilateral display according to claim 14, wherein the second portion of the first anchor includes a first notch defining a first tab about which a first end of the first elastic member is attached, and wherein the second portion of the second anchor includes a second notch defining a second tab about which a second end of the first elastic member is attached.

16. The quadrilateral display according to claim 15, wherein the second portion of the third anchor includes a third notch defining a third tab about which a first end of the second elastic member is attached, and wherein the second portion of the fourth anchor includes a fourth notch defining a fourth tab about which a second end of the first elastic member is attached.

17. The quadrilateral display according to claim 14, wherein the second portion of the first anchor and the second portion of the second anchor contact one another to stop rotation of the first section and the second section about the first joint, responsive to the bias of the first elastic member, at the deployed position, and wherein the second portion of the third anchor and the second portion of the fourth anchor contact one another to stop rotation of the third section and the fourth section about the second joint, responsive to the bias of the second elastic member, at the deployed position.

18. The quadrilateral display according to claim 11, wherein the shroud is formed from at least one of card stock, paperboard or corrugated fiberboard.

19. The quadrilateral display according to claim 11, wherein the shroud includes, along a height of the shroud, a plurality of segments, wherein each of the plurality of segments is rotatable relative an adjacent segment by a laterally-oriented joint formed between each of the plurality of segments and the adjacent segment, and wherein the plurality of segments of the shroud are foldable about the laterally-oriented joints to place the shroud in the stowed position.

20. The quadrilateral display according to claim 11, wherein the first, second, third, and fourth joints are parallel.

21. A quadrilateral display, comprising:

a shroud formed from a first substrate and a second substrate, the first substrate including a first section and a second section with a first joint formed along an axial direction of the first substrate between the first section and the second section to permit rotation of the first section relative to the second section, the second substrate including a third section and a fourth section with a second joint formed along an axial direction of the second substrate between the third section and the fourth section to permit rotation of the third section relative to the fourth section, the first substrate and the second substrate being connected at a third joint connecting the first section of the first substrate and the third section of the second substrate and a fourth joint connecting the second section of the first substrate and the fourth section of the second substrate, and the first section, the second section, the third section and the fourth section being rotatably disposed relative to adjacent ones of the first section, the second section, the third section and the fourth section;

a plurality of anchors including a first anchor attached to the first section between the first joint and the fourth joint, a second anchor attached to the second section between the first joint and the third joint, a third anchor attached to the third section between the second joint and the third joint, and a fourth anchor attached to the fourth section between the second joint and the fourth joint, the plurality of anchors being disposed in a first position within the shroud in a stowed position and a second position within the shroud in a deployed position, the first anchor separate from the second anchor, and the third anchor separate from the fourth anchor;

a first elastic member connecting the first anchor and the second anchor to bias the first anchor and the second anchor toward one another about the first joint and toward the second position;

a second elastic member connecting the third anchor and the fourth anchor to bias the third anchor and the fourth anchor toward one another about the second joint and toward the second position, wherein the first elastic member and the second elastic member bias the shroud from the stowed position to the deployed position with the first section, the second section, the third section and the fourth section forming a quadrilateral shape when the plurality of anchors are positioned in the second position.

* * * * *